US005844540A

United States Patent [19]

Terasaki

[11] Patent Number: 5,844,540

[45] Date of Patent: Dec. 1, 1998

[54] LIQUID CRYSTAL DISPLAY WITH BACK-LIGHT CONTROL FUNCTION

[75] Inventor: Hirohide Terasaki, Tenri, Japan

[73] Assignee: Sharp Kabushiki Kaisha, Osaka, Japan

[21] Appl. No.: 998,829

[22] Filed: Dec. 29, 1997

Related U.S. Application Data

[63] Continuation of Ser. No. 447,729, May 23, 1995, abandoned.

[30] Foreign Application Priority Data

May 31, 1994 [JP] Japan ..... 6-119228

[51] Int. Cl.[6] ..... G09G 3/36

[52] U.S. Cl. ..... 345/102; 345/87; 349/61

[58] Field of Search ..... 345/102, 87, 213; 349/61, 69, 70; 315/DIG. 4

[56] References Cited

U.S. PATENT DOCUMENTS

| | | |
|---|---|---|
| 4,907,862 | 3/1990 | Suntola . |
| 4,958,915 | 9/1990 | Okada et al. . |
| 4,975,692 | 12/1990 | Tateyama . |
| 4,978,952 | 12/1990 | Irwin . |
| 5,093,652 | 3/1992 | Bull et al. . |
| 5,105,127 | 4/1992 | Lavaud et al. . |
| 5,122,791 | 6/1992 | Gibbons et al. . |
| 5,142,388 | 8/1992 | Watanabe et al. . |
| 5,184,117 | 2/1993 | Gauthier . |
| 5,239,293 | 8/1993 | Barbier . |
| 5,420,481 | 5/1995 | Booth, Jr. et al. . |
| 5,440,208 | 8/1995 | Uskali et al. . |
| 5,440,324 | 8/1995 | Strickling, III . |
| 5,539,707 | 7/1996 | Wood . |

FOREIGN PATENT DOCUMENTS

| | | |
|---|---|---|
| 0406116 | 1/1991 | European Pat. Off. . |
| 4305796 | 9/1994 | Germany . |
| 404138417 | 5/1992 | Japan . |
| 405109234 | 1/1993 | Japan . |
| 5-127626 | 5/1993 | Japan . |
| 405249432 | 9/1993 | Japan . |
| 405307164 | 11/1993 | Japan . |

*Primary Examiner*—Richard A. Hjerpe
*Assistant Examiner*—Kent C. Lang

[57] ABSTRACT

A liquid crystal display with a back-light control function is provided with a PWM dimmer driving circuit section for applying a PWM dimming to a fluorescent tube provided on the back surface of a liquid crystal panel by controlling an inverter section. The PWM dimming frequency by the PWM dimmer driving circuit section is set such that m flashes occur (m is an integer of not less than n, and is not a multiple of n) in n screen display periods of the liquid crystal panel (n is an integer of not less than 2), for example, 5 frequency occurs in 2 display periods. Based on a display panel vertical synchronizing signal corresponding to the vertical driving frequency of the liquid crystal panel, the PWM dimmer driving circuit section controls the inverter section while synchronizing a lighting timing of the fluorescent tube with a driving timing of the liquid crystal panel. As a result, an occurrence of flicker and flutter can be prevented effectively. Moreover, a sound noise generated in the inverter section can be reduced. Furthermore, variations in dimming can be reduced.

22 Claims, 21 Drawing Sheets

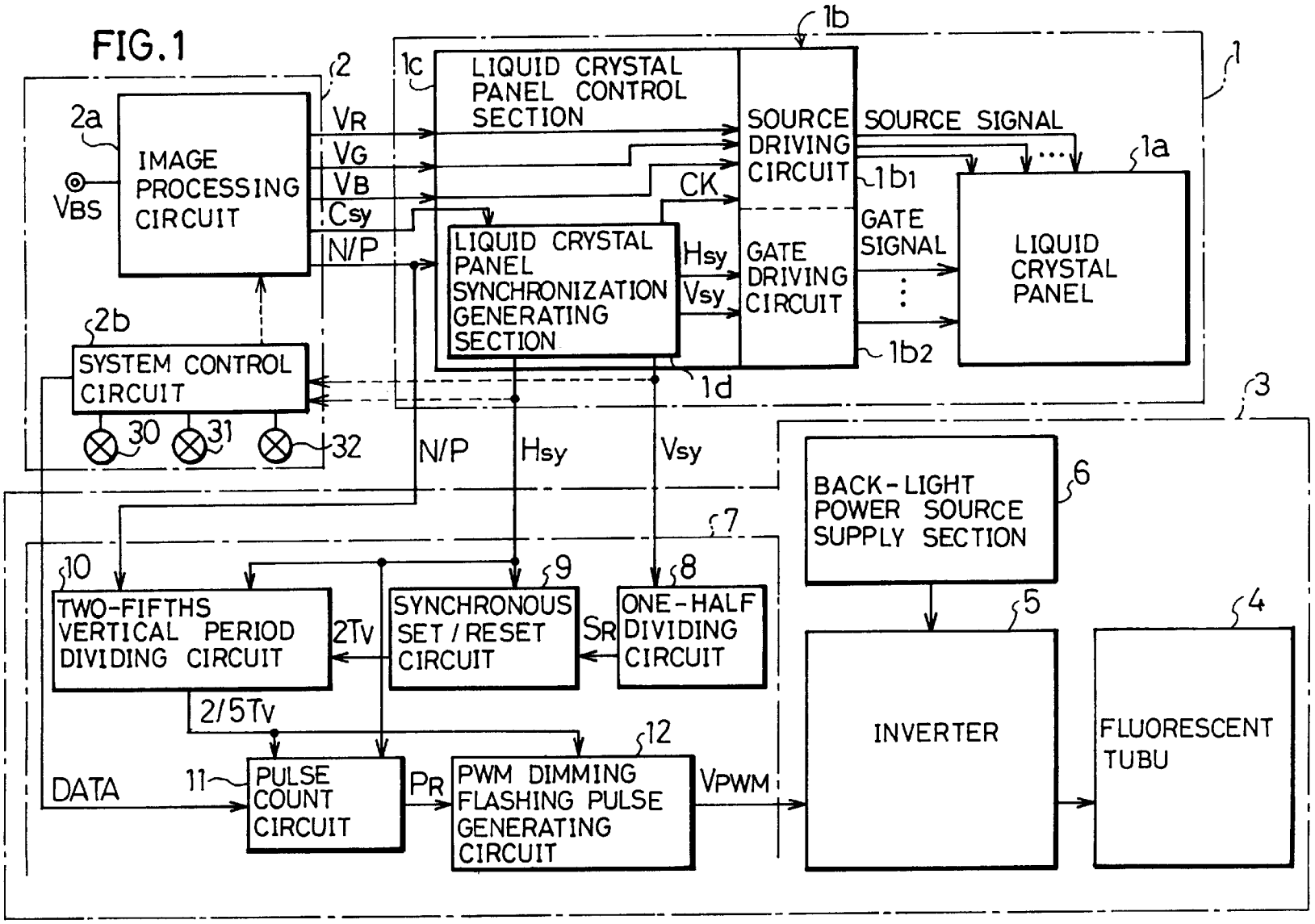
FIG. 1
1
1a
LIQUID CRYSTAL PANEL
SOURCE SIGNAL
1b1
GATE SIGNAL
1b2
1b
SOURCE DRIVING CIRCUIT
GATE DRIVING CIRCUIT
LIQUID CRYSTAL PANEL CONTROL SECTION
1c
CK
Hsy
Vsy
1d
LIQUID CRYSTAL PANEL SYNCHRONIZATION GENERATING SECTION
N/P
2
VR
VG
VB
Csy
N/P
IMAGE PROCESSING CIRCUIT
2a
VBS
SYSTEM CONTROL CIRCUIT
2b
30
31
32
3
4
FLUORESCENT TUBU
6
BACK-LIGHT POWER SOURCE SUPPLY SECTION
5
INVERTER
7
8
ONE-HALF DIVIDING CIRCUIT
SR
9
SYNCHRONOUS SET/RESET CIRCUIT
2Tv
10
TWO-FIFTHS VERTICAL PERIOD DIVIDING CIRCUIT
2/5Tv
11
PULSE COUNT CIRCUIT
PR
12
PWM DIMMING FLASHING PULSE GENERATING CIRCUIT
VPWM
DATA

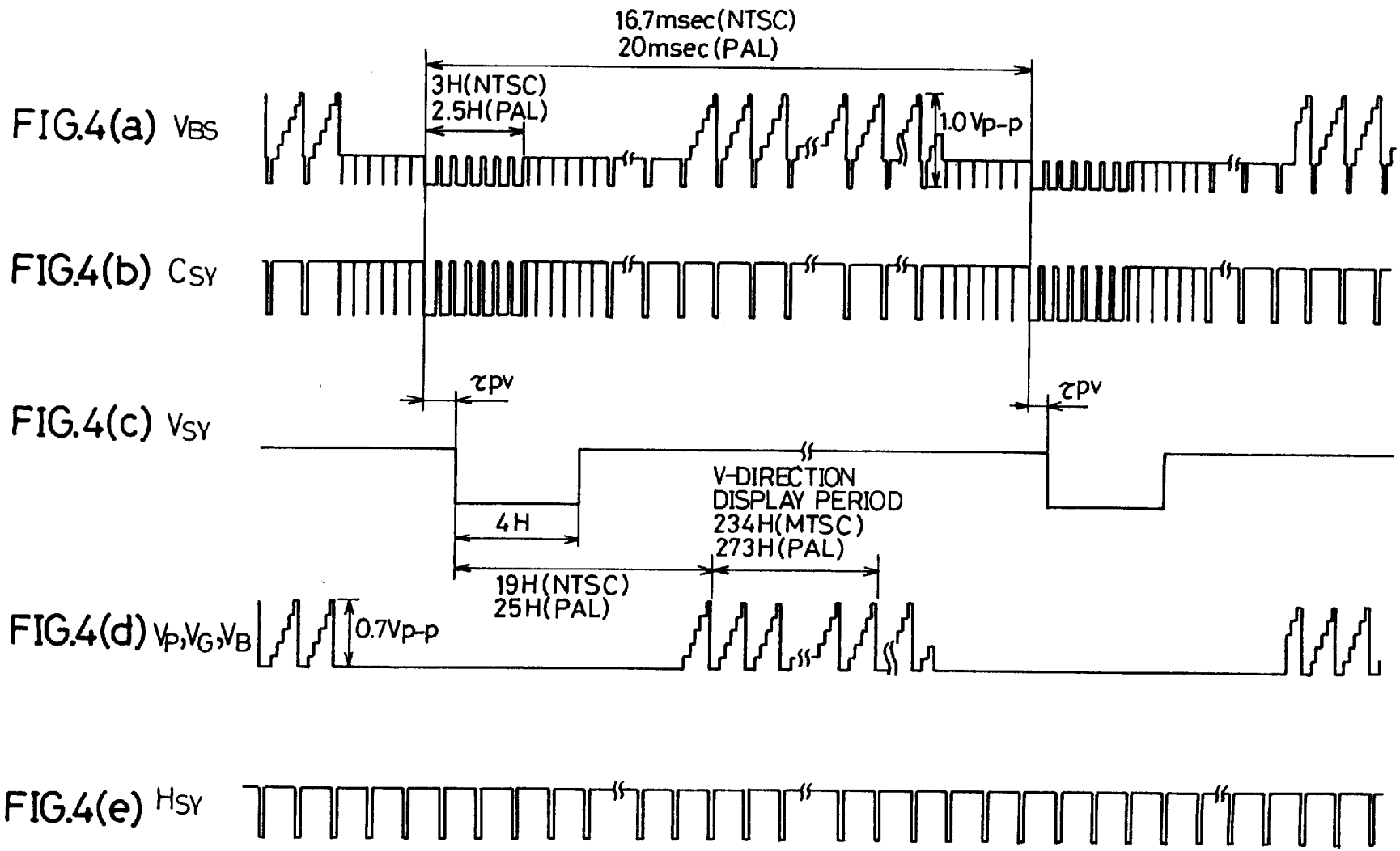
FIG.4(a) $V_{BS}$
FIG.4(b) $C_{SY}$
FIG.4(c) $V_{SY}$
FIG.4(d) $V_P, V_G, V_B$
FIG.4(e) $H_{SY}$ FIG.15(a)
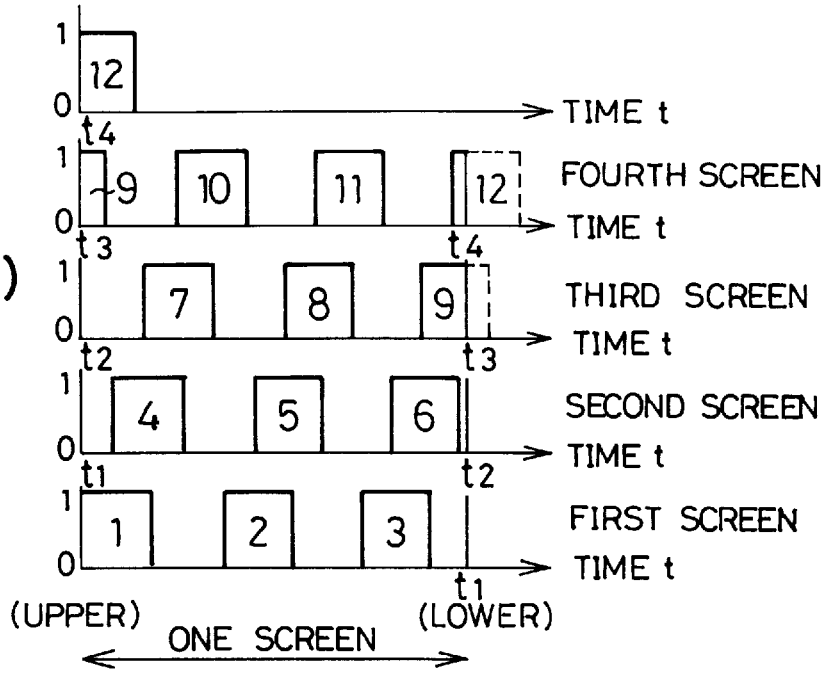
FIG.15(b)
FIG.15(c)
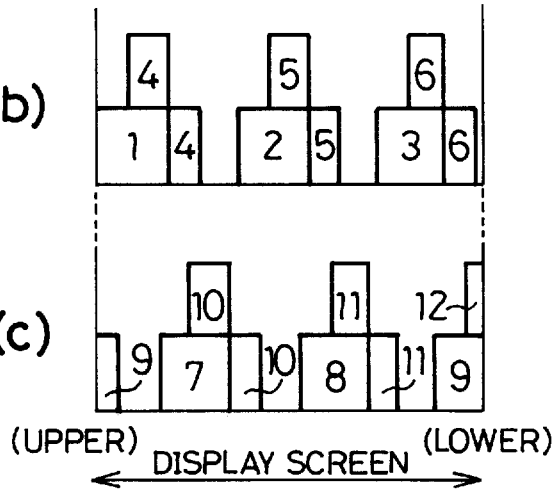
FIG.15(d)
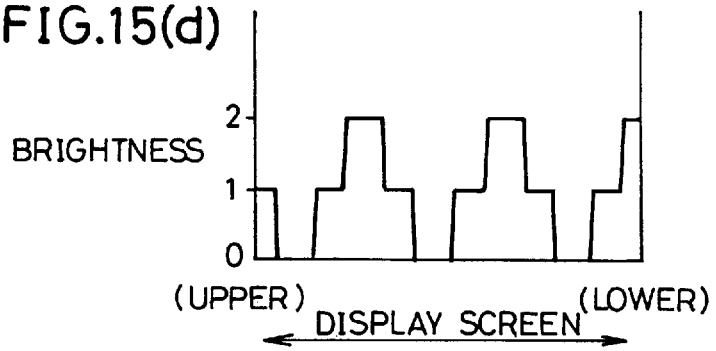

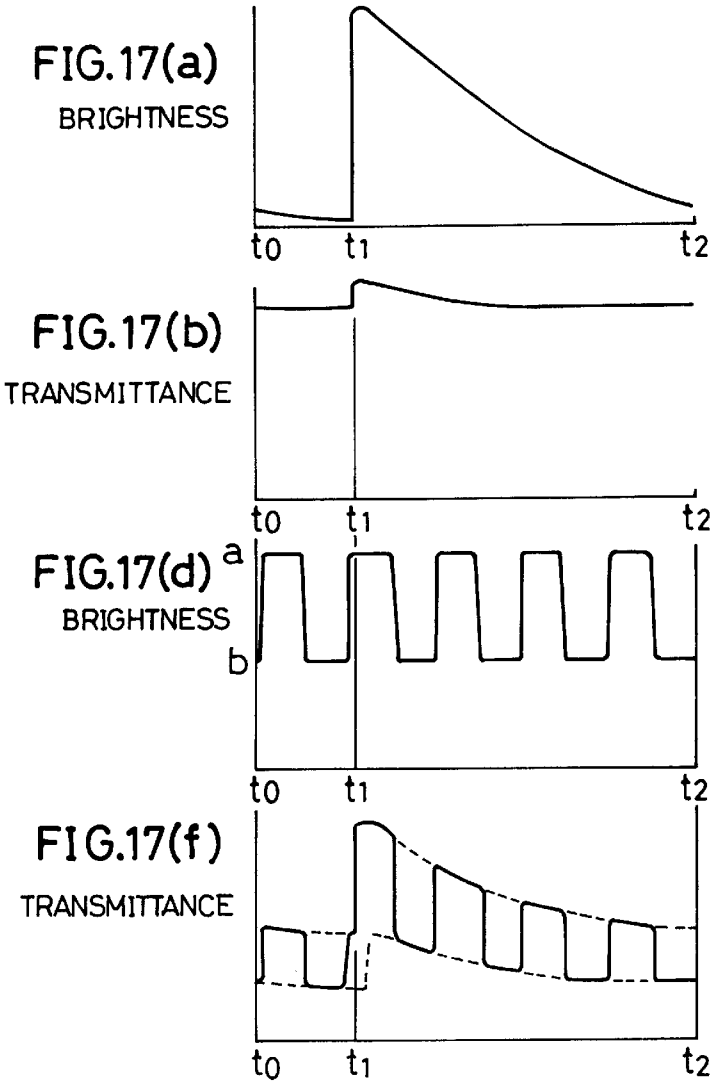
FIG.17(a)
BRIGHTNESS
FIG.17(b)
TRANSMITTANCE
FIG.17(d)
BRIGHTNESS
a
b
FIG.17(f)
TRANSMITTANCE
t0
t1
t2
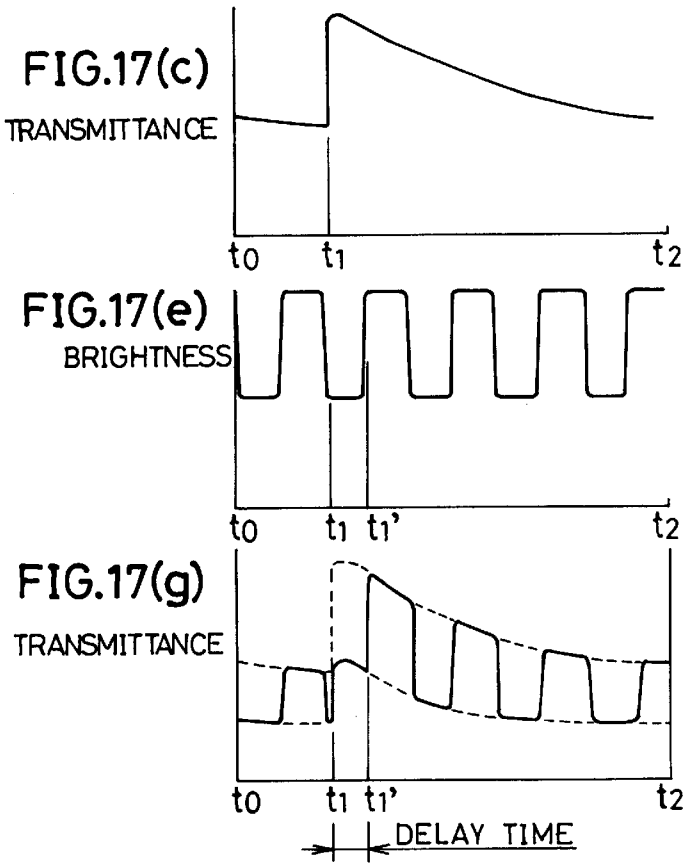
FIG.17(c)
TRANSMITTANCE
FIG.17(e)
BRIGHTNESS
FIG.17(g)
TRANSMITTANCE
t0
t1
t1'
t2
DELAY TIME

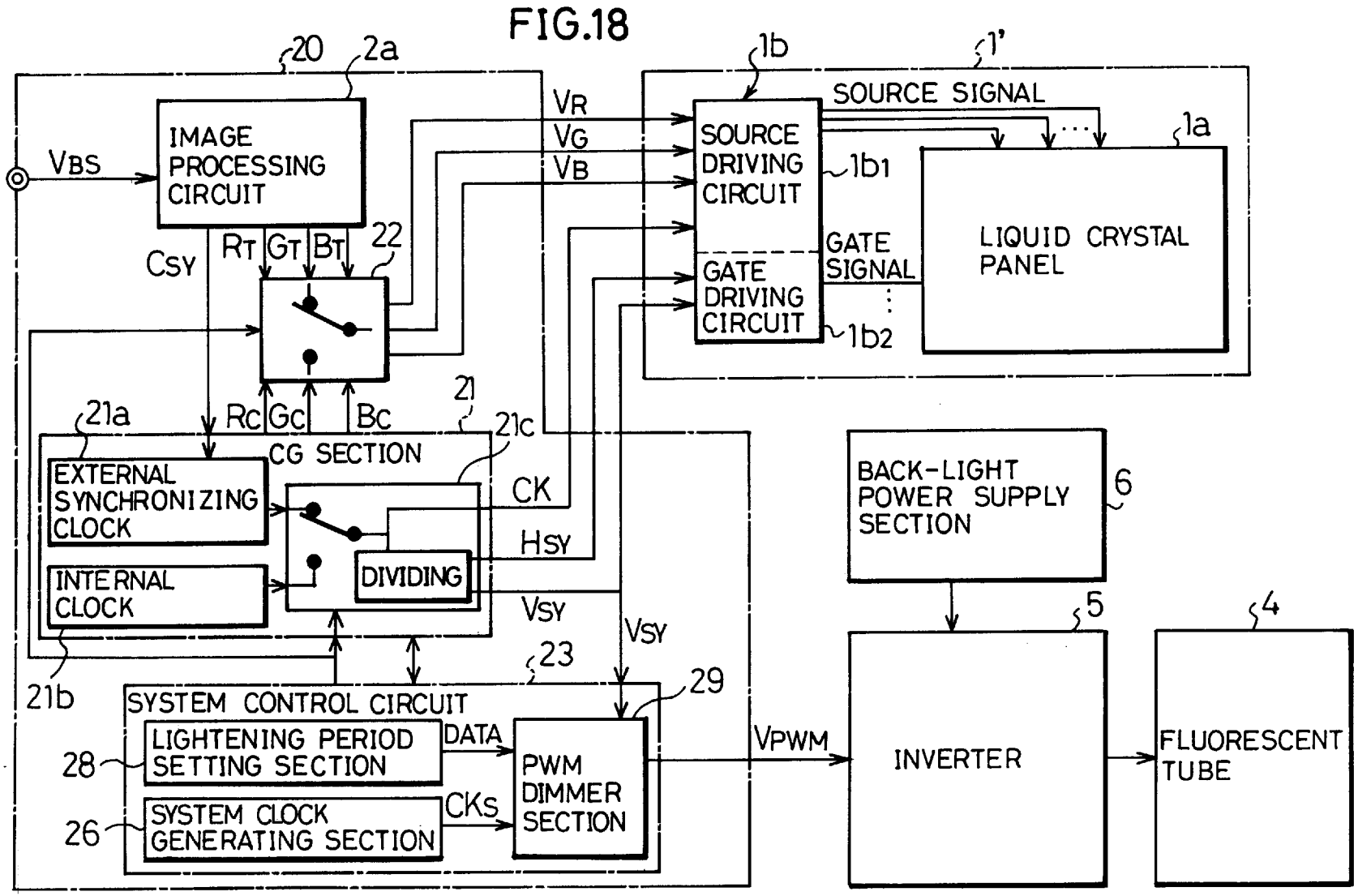
FIG.18
1'
1a
LIQUID CRYSTAL PANEL
SOURCE SIGNAL
1b1
GATE SIGNAL
1b2
1b
SOURCE DRIVING CIRCUIT
GATE DRIVING CIRCUIT
4
FLUORESCENT TUBE
6
BACK-LIGHT POWER SUPPLY SECTION
5
INVERTER
VPWM
29
PWM DIMMER SECTION
VSY
23
SYSTEM CONTROL CIRCUIT
DATA
CKs
LIGHTENING PERIOD SETTING SECTION
SYSTEM CLOCK GENERATING SECTION
28
26
VR
VG
VB
CK
HSY
VSY
21c
21
DIVIDING
CG SECTION
Bc
Gc
Rc
22
2a
20
IMAGE PROCESSING CIRCUIT
BT
GT
RT
CSY
VBS
21a
EXTERNAL SYNCHRONIZING CLOCK
INTERNAL CLOCK
21b FIG.22(a) SIGNAL a
PRIOR ART
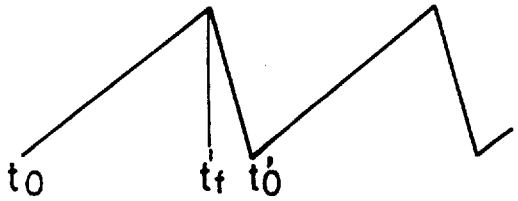
FIG.22(b) SIGNAL b
PRIOR ART
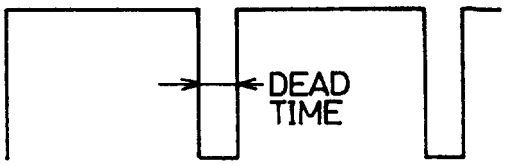
FIG.22(c) SIGNAL c
PRIOR ART
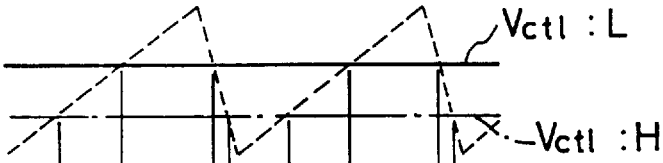
FIG.22(d) SIGNAL d
PRIOR ART
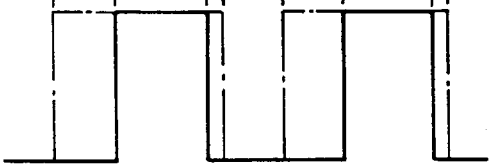
FIG.22(e) SIGNAL e
PRIOR ART
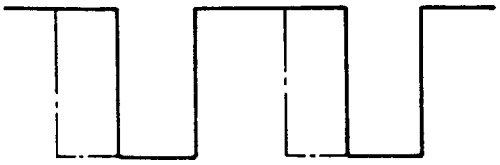
FIG.22(f) INVERTER OSCILLATION
PRIOR ART
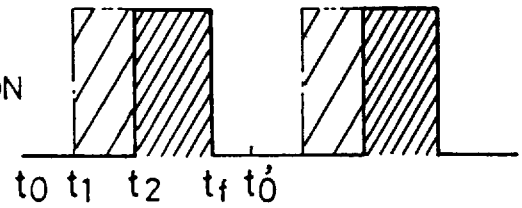

LIQUID CRYSTAL DISPLAY WITH BACK-LIGHT CONTROL FUNCTION

This application is a continuation of copending application Ser. No. 08/447,729, filed on May 23, 1995, the entire contents of which are hereby incorporated by reference.

FIELD OF THE INVENTION

The present invention relates to a liquid crystal display with a back-light control function, having a light source formed on the back surface of a liquid crystal panel, and more particularly relates to a liquid crystal display with a back-light control function for dimming by periodically flashing the light source with a varying time ratio between a light-on duration and a light-out duration.

BACKGROUND OF THE INVENTION

A liquid crystal display panel which displays by driving a liquid crystal corresponding to each picture element is known. Such liquid crystal display panel displays either by reflecting externally generated light which is transmitted through the liquid crystal panel or by the emission of an illuminant formed on the back surface of the liquid crystal panel as the liquid crystal itself does not emit light.

The light emitting source formed on the back surface of the liquid crystal display panel is generally called "back-light", and a fluorescent tube is often used for the back-light. The fluorescent tube has the following mechanism: First, discharging occurs inside the tube when a high voltage is applied across the electrodes on both ends of the tube, and an ultraviolet ray is released when mercury vapor in the tube excited to the high energy level caused by this discharging energy, and is lowered to the initial energy level. Then, the ultraviolet ray is converted into visible light by a phosphor applied to the surface of the tube, thereby emitting light.

In order to emit light from the fluorescent tube, an application of high voltage is required. For this reason, generally, DC power of low voltage is converted into AC power of high voltage having high frequency (10 K–100 KHz) by an inventor to be supplied to the fluorescent tube.

As a conventional method of dimming the back-light of the liquid crystal, the voltage control dimming system or the PWM (Pulse Wide Modulation) dimming system are known.

The voltage controlled dimming method includes current control and current feedback control. According to the voltage control dimming system, dimming is performed by varying an input voltage to the inverter so as to adjust an output voltage from the inverter (i.e., an application voltage to the fluorescent tube). As the fluorescent tube emits light using discharging energy, when the application voltage to the fluorescent tube is too low, the discharging becomes unstable. For this reason, a large dimming range cannot be achieved by the voltage control dimming system, and the possible dimming ratio is around 2:1.

On the other hand, the PWM dimming system is a time sharing system, and according to the PWM dimming system, dimming is performed by periodically flashing the light source with a varying time ratio between the light-on duration and the light-out duration. Therefore, the PWM dimming system offers a large dimming ratio (Even a dimming ratio of greater than 100:1 is possible). For the described feature, the PWM dimming system is used when a large dimming ratio is required.

The conventional back-light device adopting the PWM dimming system is explained in reference to FIG. 21 and FIG. 22(*f*). As shown in FIG. 21, the back-light device is composed of a PWM dimmer driving circuit section 51, an inverter section 52, a power source 53 for the inverter section 52 and a fluorescent tube 54.

The PWM dimmer driving circuit 51 is composed of a triangular wave oscillating circuit 55, a waveform setting section 56, an operational amplifier 57, a comparator 58 and a NAND gate 59. The driving duration for the fluorescent tube 54 by the PWM dimmer driving circuit section 51 is a fixed duration. From the triangular wave oscillating circuit 55, a triangular wave signal a (see FIG. 22(*a*)) for determining the driving period is outputted at a predetermined frequence. The waveform of the triangular wave signal a are determined by the waveform setting section 56. More specifically, in FIG. 22(*a*), the waveform of the triangular wave signal a in the time period from $t_0$ to $t_f$ is determined by a time constant of a resistance $R_{on}$ and a condenser $C_f$ of the waveform setting section 56, and the waveform of the triangular wave signal a for a time period from $t_f$ to $t_0'$ is determined by the time constant of the resistance $R_{off}$ and the condenser $C_f$ of the waveform setting section 56.

As shown in FIG. 22(*b*), from the triangular wave oscillating circuit 55, a dead time signal b which is "L level" only for the time period from $t_f$ to $t_0'$ in one period from to $t_0$ $t_0'$ is outputted. During the period where the dead time signal b is "L level" is the dead time in the one period of the PWM dimming (emitting light stopping period) to limit the light-on period.

By controlling the brightness controller of the display, a DC control input signal $V_{ctl}$ corresponding to the operation volume is inputted into the PWM dimmer driving circuit section 51. Here, from the operation amplifier 57, as shown in FIG. 22(*c*), a signal c corresponding to the DC voltage level of the control input signal $V_{ctl}$ is outputted to the comparator 58, and the signal c is compared with the triangular wave signal a in the comparator 58. For convenience in the explanations, two levels of the signal c are shown in FIG. 22(*c*) so as to correspond to the control input signal $V_{ctl}$ of the L (minimum) level and the control input signal $V_{ctl}$ of the H (maximum) level. However, the level of the signal c is variable between the two levels.

As shown in FIG. 22(*d*), from the comparator 58, a signal d corresponding to the level of the signal c is outputted to the NAND gate 59. From the NAND gate 59, a signal e to which the limit of the light-on duration is given by the dead time signal b is outputted to the inverter section 52 as shown in FIG. 22(*e*). As a result, for example, as shown in FIG. 22(*f*), when the control input signal $V_{ctl}$ is low level, the inverter section 52 oscillates only for the time period from $t_2$ to $t_f$. On the other hand, when the control input signal $V_{ctl}$ is high level, the inverter section 52 oscillates only for the time period from $t_1$ to $t_f$. Namely, by varying the level of the analog control input signal $V_{ctl}$, the oscillating duration of the inverter section 52 varies, thereby performing dimming by varying the time ratio between the light-on duration and the light-out duration of the fluorescent tube 54.

The conventional back-light device adopting the PWM dimming system has the problems of generating flicker and sound noise, and an unstable brightness (variation in dimming), etc.

As to the flicker, if the frequency of the flicker is greater than a predetermined level (normally, greater than the number of comas fed per second in the case of normally showing a picture), people will not perceive the flicker. For example, in the case of the generally used fluorescent lighting, when a commercial use AC power source of 50 Hz (60 Hz) is adopted, two flashes occur per 1 cycle of the power source, and the flashing frequency is high (100 Hz (120 Hz)), and the flickering does not come to one's eyes. In the described conventional back-light device, people will not feel flicker when it is used as a single light source. However, when the conventional back-light device is applied to the back-light of the liquid crystal panel, as the display driving frequency of the liquid crystal panel is not identical with the lighting frequency of the back-light, the flicker may stand out depending on a pattern of the image.

When the PWM dimming system is applied to the display panel with a back-light control function for performing picture display of a video signal which is synchronized both horizontally and vertically, it is required to set the PWM dimming lighting frequency $f_{sw}$ to satisfy the following inequality in order to prevent the flicker with respect to the vertical synchronizing frequency $f_v$ of the display panel:

$$f_{sw}))f_v$$

By adopting such a high PWM dimming lighting frequency $f_{sw}$, a high flickering frequency can be obtained. Therefore, even if the display frequency of the screen is not in synchronous with the lighting frequency of the fluorescent tube 54, an occurrence of the flicker can be prevented.

In the case of a television signal of the NTSC system, as the vertical synchronizing frequency $f_v$ is 60 Hz, it is preferable that the PWM dimming lighting frequency $f_{sw}$ is set around 600 Hz which is ten times as high as the vertical synchronizing frequency $f_v$. However, when the PWM dimming lighting frequency is set to such a high frequency, the oscillation from the inverter section 52 cannot follow the input signal e from the PWM dimmer driving circuit 51, and thus the oscillating output efficiency is lowered. Moreover, at the transition stage of starting and stopping the oscillation in the inverter section 52, an electromagnetic noise generates (details will be described later), and the total amount of this electromagnetic noise increases when the PWM dimming lighting frequency $f_{sw}$ is high. Furthermore, when the PWM dimming lighting frequency $f_{sw}$ is high, one period of the PWM dimming becomes short, thereby presenting the problem that a large dimming ratio cannot be achieved.

As described, by adopting a higher PWM dimming lighting frequency $f_{sw}$, a greater effect of preventing the flicker can be achieved. However, considering the described noise, oscillating efficiency, dimming ratio, etc., the PWM dimming lighting frequency is normally set to around 300–400 Hz where the flicker is not obvious comparatively.

For the inverter section 52, an oscillating circuit of the self-excited and voltage resonance type is generally used as shown in FIG. 21. At the transition stage between the oscillation and the stoppage of the oscillation in the inverter section 52, a pulse current flows into the choke coil L, and this sudden change in current causes electromagnetic noise to generate (generation of sound noise). Especially, a large electromagnetic noise is generated when stopping the oscillation. Here, the total amount of the electromagnetic noise becomes larger by setting the PWM dimming lighting frequency $f_{sw}$ higher.

By the operation of the inverter section 52 of large current and high voltage, noise is generated (for example, due to a transitional change in current at the start of the oscillation), and the noise is superimposed on the control input signal $V_c$. This causes variations in voltage level of the signal $V_{ctl}$ to be inputted to the comparator 58, and a constant time ratio between the light-on duration and the light out duration cannot achieved, thereby presenting the problem of unstable brightness (variations in dimming). The noise generated in the inverter 52 also affects the triangular wave oscillation circuit 55 of the PWM dimmer driving circuit section 51, and causes variations in lighting frequency. This noise is one of the cause of flicker and flutter.

Japanese Laid-Open Patent Application No. 127626/1993 (Tokukaihei 5-127626) discloses a technique for synchronizing the start timing of the display driving of a segment display with the start timing of lighting the back-light. In the application of this technique to a liquid crystal display for displaying a television signal of the NTSC system, for example, when synchronizing the lighting period of the back-light with the horizontal of the frequency of the display, the PWM dimming lighting frequency $f_{sw}$=15.75 kHz. Since this lighting frequency is too high, considering the inverter frequency, the PWM dimming cannot be achieved in practice. On the other hand, when synchronizing the lighting period of the back-light with the vertical frequency of the display, a low PWM dimming lighting frequency $f_{sw}$=60 Hz (=vertical synchronizing frequency fv) can be achieved. However, in this case, the following problems are presented.

Namely, when synchronizing the start timing of lighting the back-light with the start timing of the vertical display, as shown in FIG. 23, the back-light flashes for a predetermined period at a start of scanning each screen, and the lighting frequency becomes such that one flash occurs in one screen period, i.e., two flashes occur in two screen periods. In FIG. 23, "1" and "0" on the vertical axis respectively indicate the light-on state and the light-out state. In the figure, the duty factor of the lighting period is set to 50%.

As a display driving system for the liquid crystal display, a linear sequential scanning system for sequentially scanning from the top end line to the bottom end line on the screen is known. In this system, as shown in FIG. 24, the back-light flashes while scanning from the top end line to the Nth line (the middle line in the case of 50% duty factor). On the other hand, the back-light is turned off while scanning from the Nth line to the bottom end line on every screen.

The liquid crystal device is capacitive, and the signal (charge) supplied to a picture element by scanning the previous screen is held to some degree until the scanning of the next screen. However, the holding amount of charge in the picture element is also gradually reduced until the next scanning operation. The explanations will be given through an example shown in FIG. 25 where the liquid crystal module of the active matrix driving system using a picture element driving active element is adopted such as the TFT (Thin Film Transistor), etc. FIG. 25 shows time variation of the light transmittance of a picture element on a scanning line in the liquid crystal display of the normally black type (negative display type), wherein the picture element is set in the untransmittable mode in the normal condition, and upon supplying a signal to the picture element, it is set in the transmittable mode. As shown in FIG. 25, the highest light transmittance is shown directly after $t_{write}$ at which a signal is applied to the picture element by scanning, and thereafter, the transmittance is gradually lowered until the next scanning operation.

As described, in the area from the top end line to the Nth line on one screen, a scanning is always performed during the light-on period of the back-light. In other words, when the highest transmittance of each picture element in the area is shown, the back-light is always set in the ON state. On the other hand, in the area from the Nth line to the bottom end line on the screen in one period, a scanning is always performed in the light-out period of the back-light. In other words, when the highest transmittance of each picture element in the area is shown, the back-light is always set in the off state, and the back-light flashes after the transmittance is lowered.

Therefore, the difference in transmittance arises between the upper portion and the lower portion of the display screen, i.e., the upper portion is brighter and the lower portion is darker. This variation in brightness occurs at a constant frequency, thereby causing flicker.

For a fuller understanding of the nature and advantages of the invention, reference should be made to the ensuing detailed description taken in conjunction with the accompanying drawings.

SUMMARY OF THE INVENTION

An object of the present invention is to provide a liquid crystal display with a back-light control function which effectively prevents an occurrence of flicker and reduces sound noise.

In order to achieve the above object, the liquid crystal display with a back-light control function in accordance with the present invention includes:

(1) a liquid crystal panel;

(2) display panel driving means for periodically displaying on the liquid crystal display panel by periodically supplying thereto a driving signal;

(3) a light source formed on a back surface of the liquid crystal display panel;

(4) light source driving means for driving the light source; and (5) dimmer means for dimming with a varying time ratio between a light-on duration and a light-out duration in one lighting period by controlling the light source driving means so as to periodically flash the light source. The dimmer means controls the light source driving means so as to set the lighting frequency for flashing the light source such that m flashes occur (m is an integer of not less than n, and not a multiple of n) in n screen display periods of the liquid crystal panel (n is an integer of not less than 2).

In the described arrangement, the dimmer means controls the light source driving means so as to apply the PWM dimming to the light source formed on the back surface of the liquid crystal display panel. The PWM dimming frequency by the dimmer means is set so as to flash the light source m times (m is greater than n, and is not a multiple of n) in n screen display periods (n is an integer of not less than 2). In the described condition, the light source flashes at least once in one screen display period. Therefore, when considering only the case of one screen display period (one screen), brightness and darkness always exist on a time axis. In the described case of the liquid crystal display panel, a display composed of sequential plural screens is formed at a predetermined frequency with respect to a two-dimensional display area. The darkness and brightness of the image must be considered including a flashing timing of sequential two screens.

In the described sequential plural screens, in the case of considering two screens in one period, for example, when adopting such a frequency that two flashes occur in two display screen periods, the flashing timings of sequential two screens become identical. Therefore, when overlapping the two screens, a pair of brightness and darkness patterns having a wide variation range in brightness is shown. On the other hand, for example, when adopting such a frequence that three flashes occur in two display screen periods, the flashing timing greatly differs between the two sequential screens. Therefore, when overlapping the two screens, three pairs of brightness and darkness patterns having a small variation range in brightness are shown. Therefore, by adjusting the lightening frequency, the variation range in brightness in a predetermined display screen period can be set small, and the frequency of the relative brightness can be set high, thereby enabling an occurrence of flicker to be effectively prevented.

Another object of the present invention is to provide a liquid crystal display with a back-light control function which effectively prevents an occurrence of flutter as well as flicker.

In order to achieve the object, it is preferable that the liquid crystal display with a back-light control function having the aforementioned arrangement (1)–(5) further includes:

(6) vertical synchronizing signal generation means for generating a display panel vertical synchronizing signal corresponding to a vertical driving period of the liquid crystal display panel generated by the display panel driving means.

The dimmer means includes synchronization means for synchronizing a lighting timing of the light source with the driving timing of the liquid crystal display panel and controls the light source driving means while synchronizing the lighting timing of the light source and the driving timing of the liquid crystal display panel.

According to the described arrangement, even a small phase difference between the lighting timing of the light source and the driving timing of the liquid crystal panel can be adjusted at every predetermined screens by the synchronization means for synchronizing the lighting timing of the light source with the driving timing of the liquid crystal display panel. As a result, a relative relationship between the lighting period of the light source and the driving period of the liquid crystal display panel can be maintained constant, thereby preventing an occurrence of flutter.

A still another object of the present invention is to provide a liquid crystal display with a back-light control function which ensures a stable lightning frequency by suppressing an adverse effect from noise and preventing an occurrence of flicker.

In order to achieve the above object, it is preferable that the liquid crystal display with a back-light control function having the aforementioned arrangement (1)–(5) further includes:

(7) horizontal synchronizing signal generation means for generating a display panel horizontal synchronizing signal corresponding to a horizontal driving frequency of the liquid crystal display panel which is driven by the display panel driving means. The dimmer means includes dividing means for dividing a frequency of the display panel horizontal synchronizing signal. The lighting frequency of the light source is set by dividing the frequency of the horizontal synchronizing signal.

According to the described arrangement, since the lighting frequency of the light source is obtained by dividing the frequency of the display panel horizontal synchronizing signal corresponding to the horizontal driving frequency which has a relative relationship with the vertical driving frequency, a phase difference between the lighting timing of the light source and the driving timing of the liquid crystal display panel can be reduced, thereby preventing an occurrence of flutter.

In the conventional method, the lighting frequency is determined using the oscillation means such as a triangular wave oscillation circuit, thereby presenting the problem that a constant lighting frequency cannot be achieved due to a fact that the oscillation means is affected by noise generated in the inverter circuit. In order to counteract the above-mentioned problem associated with the conventional method, the present invention is arranged so as to obtain the lighting frequency by dividing the frequency of the display panel horizontal synchronizing signal. As a result, a stable lighting frequency can be achieved without having an adverse effect from noise.

A still another object of the present invention is to provide a liquid crystal display device with a back-light control function which ensures a desirable display condition by preventing not only an occurrence of flicker but also unstable brightness (variation in dimming).

In order to achieve the above object, it is preferable that the liquid crystal display with a back-light control function having the described arrangement of (1)–(5) and (7) further includes:

(8) light-on period setting means for setting a light-on duration in one lighting period of the light source.

The dimmer means includes count means for counting a number of pulses of the display panel horizontal synchronizing signal, and determines the light-on duration to be set by the light-on period set means based on a count indicating a number of pulses in the display panel horizontal synchronizing signal.

According to the described arrangement, the dimmer means controls the light source driving means so as to have the light-on duration set by the light-on period setting means. The dimmer means obtains the light-on period set by the light-on period setting means based on a count of the display panel horizontal synchronizing signal. Therefore, the problem of unstable brightness (variation in dimming) associated with the PWM dimming of the conventional analog system can be avoided. Namely, in the conventional PWM dimming of the analog system, the noise generated in the inverter circuit is superimposed on the control input signal $V_{ctl}$ (see FIG. 21), and a constant time ratio between the light-on duration and the light-out duration cannot be achieved, thereby creating the problem of unstable brightness. However, in the arrangement of the present invention where the light-on duration is determined by a count value of the display panel horizontal synchronizing signal, an adverse effect from noise can be prevented.

For a fuller understanding of the nature and advantages of the invention, reference should be made to the ensuing detailed description taken in conjunction with the accompanying drawings.

BRIEF DESCRIPTION OF THE DRAWINGS

FIG. 1 which shows one embodiment of the present invention is a block diagram showing a schematic configuration of the liquid crystal display with a back-light control function.

FIG. 4(*a*) through FIG. 4(*e*) are timing charts showing respective waveforms of various signals in an image processing/system control section and in a liquid crystal panel synchronization forming section of the liquid crystal display.

FIG. 15(*a*) through FIG. 15(*d*) are diagrams explaining a brightness and darkness pattern formed in the display screen when the PWM dimming is applied at a frequency of 5.6 flashes in two vertical periods.

FIG. 17(*a*) through FIG. 17(*g*) are explanatory views showing an occurrence of flutter when the PWM dimming timing is not synchronized with the driving timing of the display screen at every predetermined screens.

FIG. 18 is a block diagram explaining another embodiment of the present invention, which shows a schematic structure of the liquid crystal display with a back-light control function.

FIGS. 21 through FIG. 25 show prior art.

FIG. 21 is a circuit diagram showing a schematic configuration of a conventional back-light device of the PWM dimming system.

FIGS. 22(*a*) through FIG. 22(*f*) are waveform charts showing respective waveforms of various signals in the conventional back-light device.

FIG. 23 is an explanatory view showing a flashing timing of the PWM dimming with such a frequency that two flashes occur in two vertical periods.

FIG. 24 is explanatory view for explaining a brightness and darkness pattern formed in the display screen when carrying out the PWM dimming at the flashing timing shown in FIG. 23.

FIG. 25 is an explanatory view showing a time variation in light transmittance in a picture element of the liquid crystal panel.

DESCRIPTION OF THE EMBODIMENTS

[Embodiment 1]

Figures 5A, 5B, 5C, 5D, 5E, 5F, 5G:
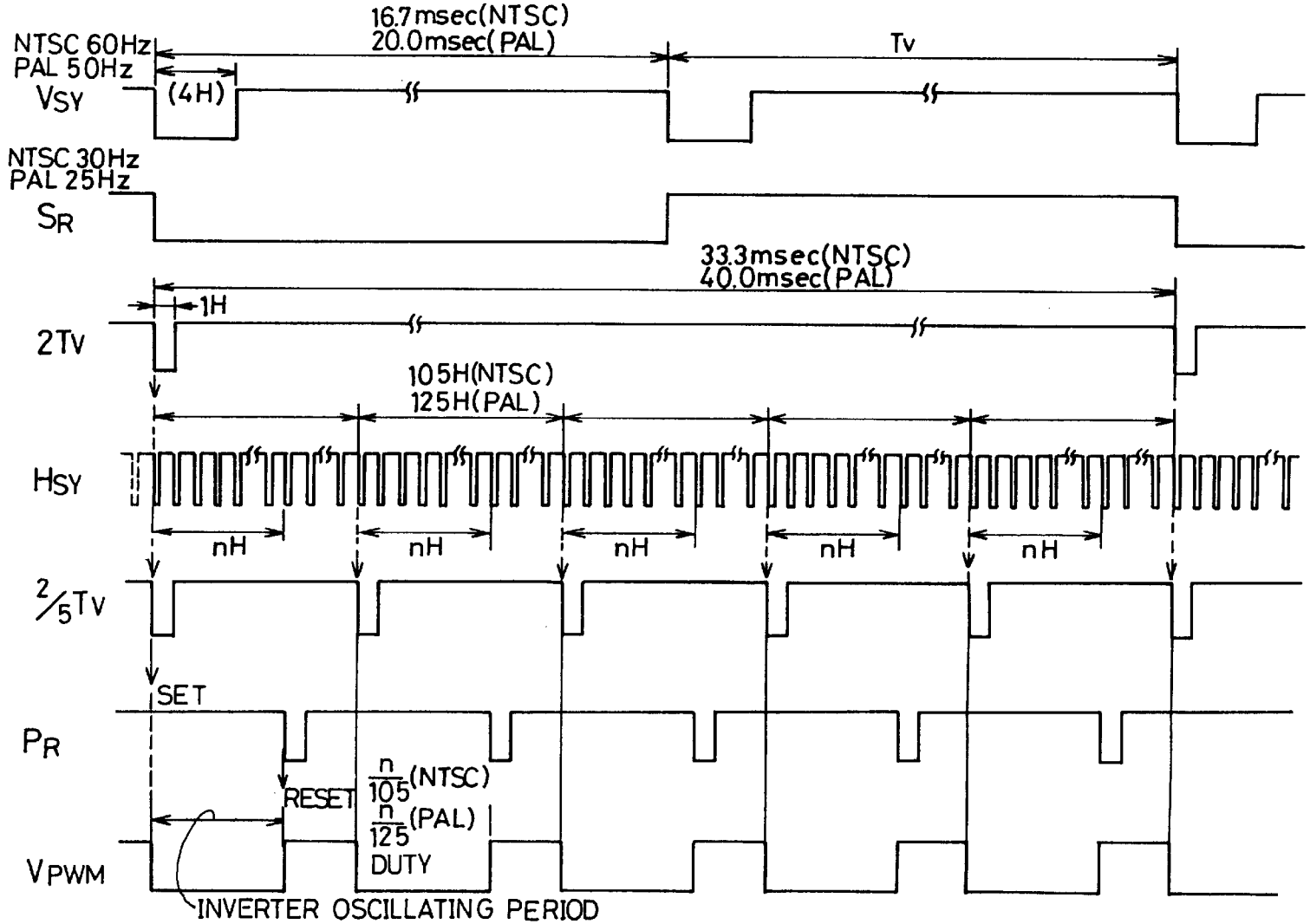
FIG. 5(*a*) through FIG. 5(*g*) show one example of timing charts which show respective waveforms of various signals in the PWM dimmer driving circuit section of the liquid crystal display.
Figure 6:
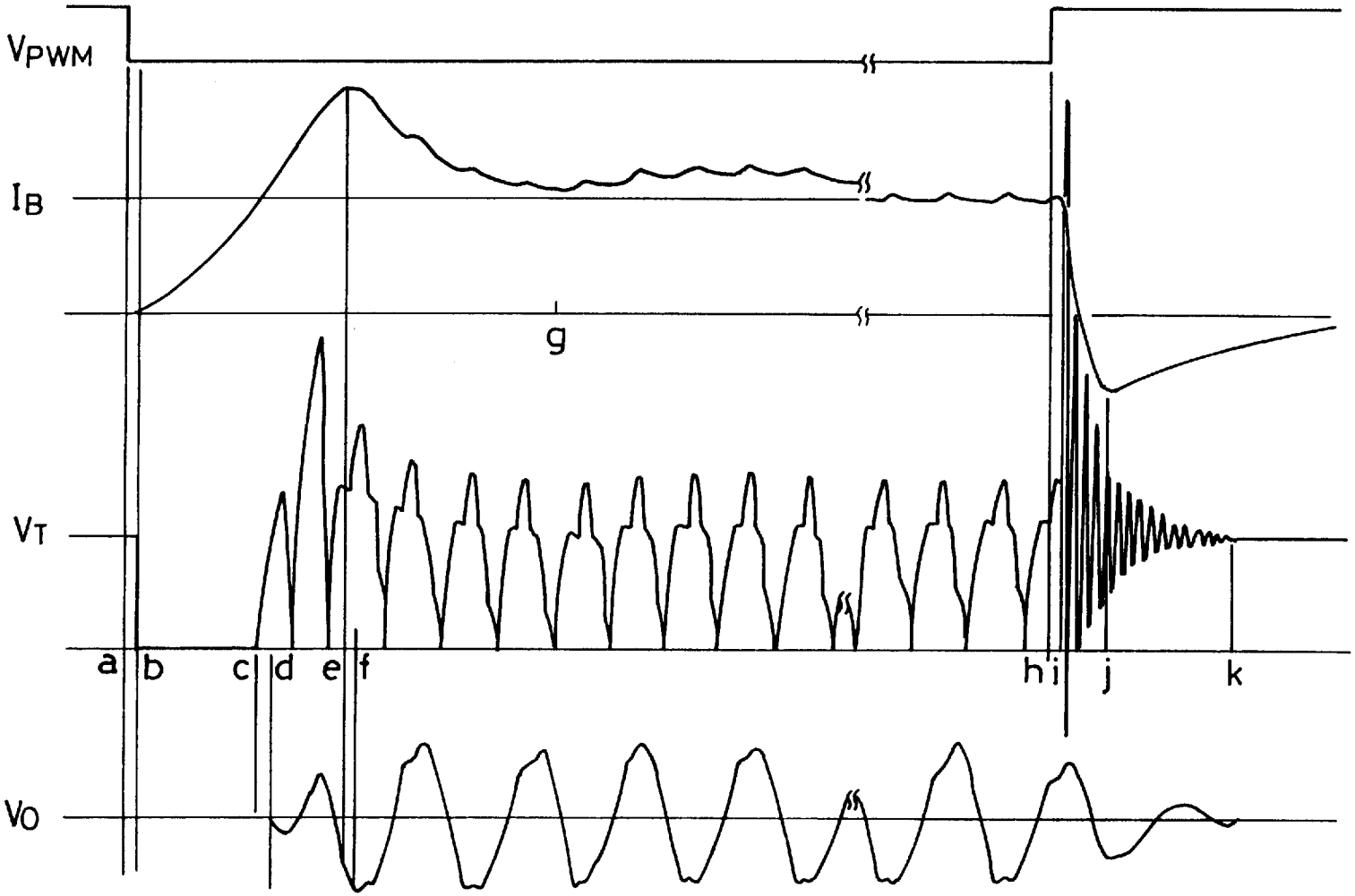
FIG. 6 is a timing chart which shows current, voltage and waveforms of various signals in an inverter section of the liquid crystal display device.
Figure 7:
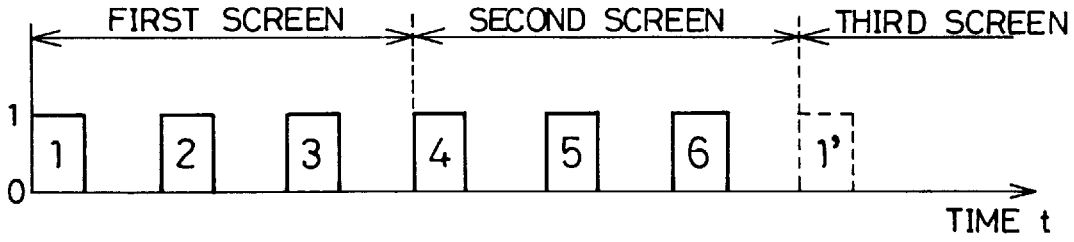
FIG.7 PRIOR ART
FIG. 7 is an explanatory view showing a flashing timing of the PWM dimming in which six flashes occur in two vertical periods.
Figure 8A:
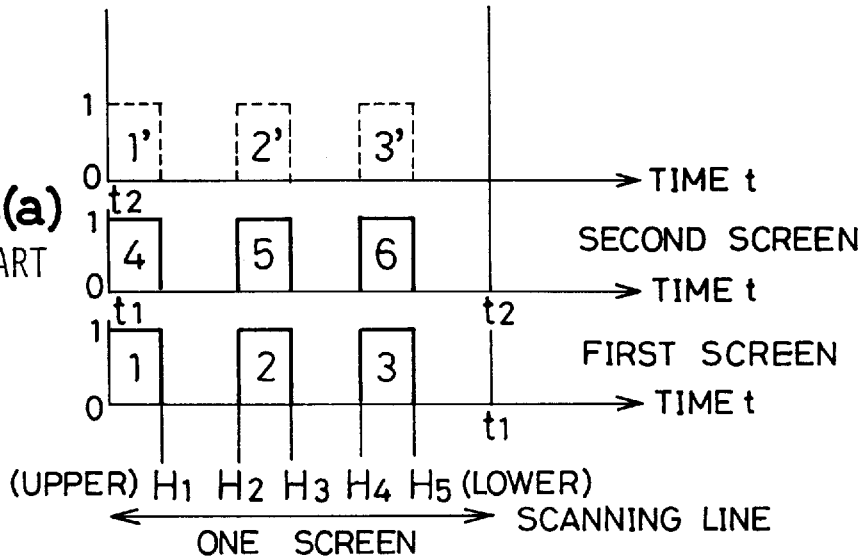
FIG.8(a) PRIOR ART
FIG. 8(*a*) and FIG. 8(*b*) are explanatory views for explaining brightness and darkness patterns formed in the display screen which is subject to the PWM dimming at the flashing timing of FIG. 7.
Figure 8B:
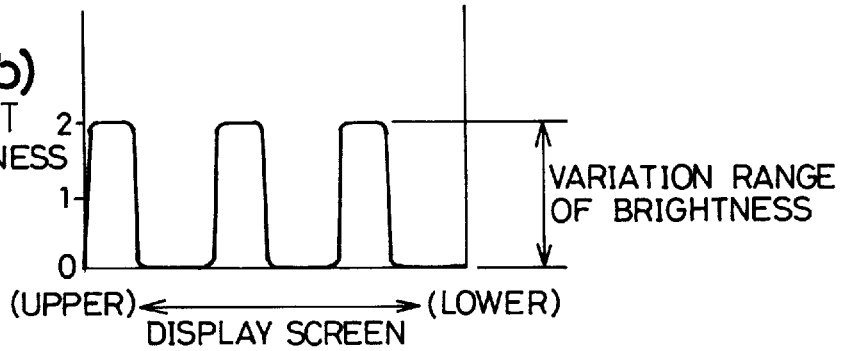
FIG.8(b) PRIOR ART
Figure 11:
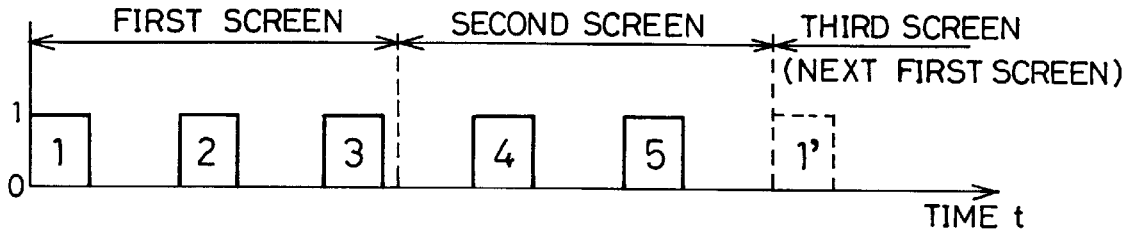
FIG. 11 is an explanatory view showing a flashing timing of the PWM dimming with such a frequency that five flashes occur in two vertical periods.
Figure 12A:
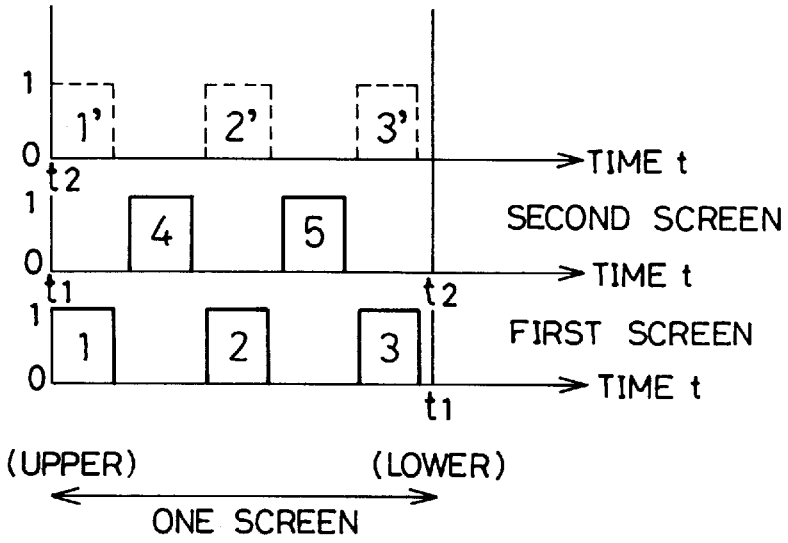
FIG. 12(*a*) through FIG. 12(*c*) are explanatory views for explaining a brightness and darkness pattern formed in the display screen when the PWM dimming is applied at the flashing timing of FIG. 11.
Figure 12B:
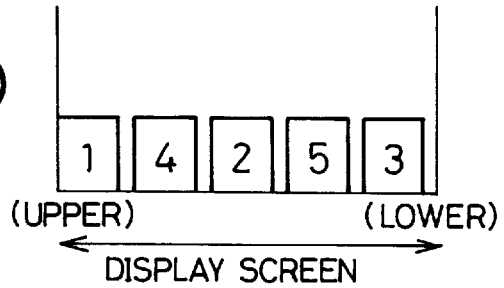
Figure 12C:
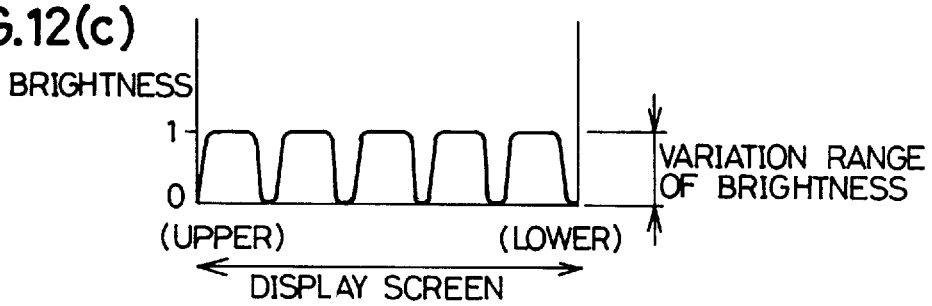
Figure 13A:
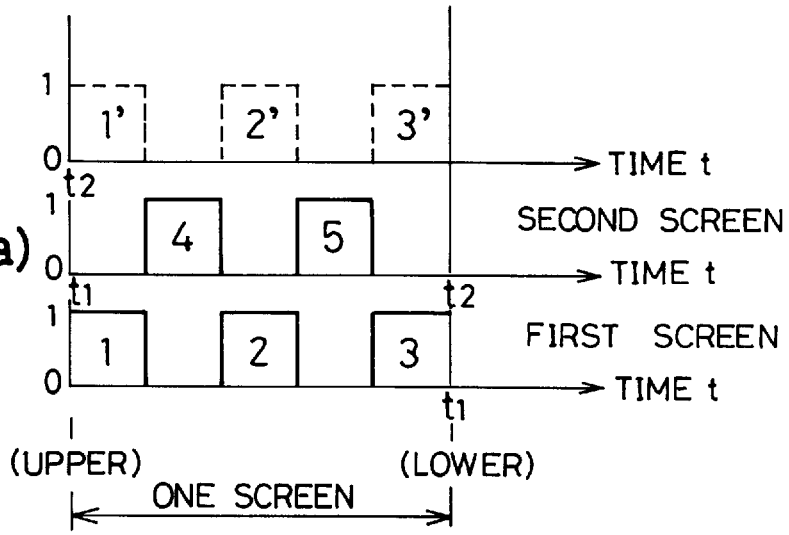
FIG. 13(*a*) through FIG. 13(*c*) are explanatory views for explaining a brightness and darkness pattern formed in the display screen when the PWM dimming is applied at the same timing as the PWM dimming timing shown in FIG. 11 with a duty factor altered to 50%.
Figure 13B:
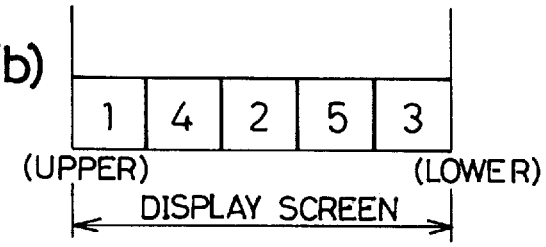
Figure 13C:
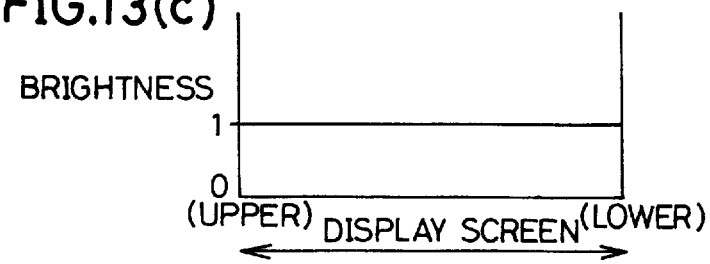
Figure 14A:
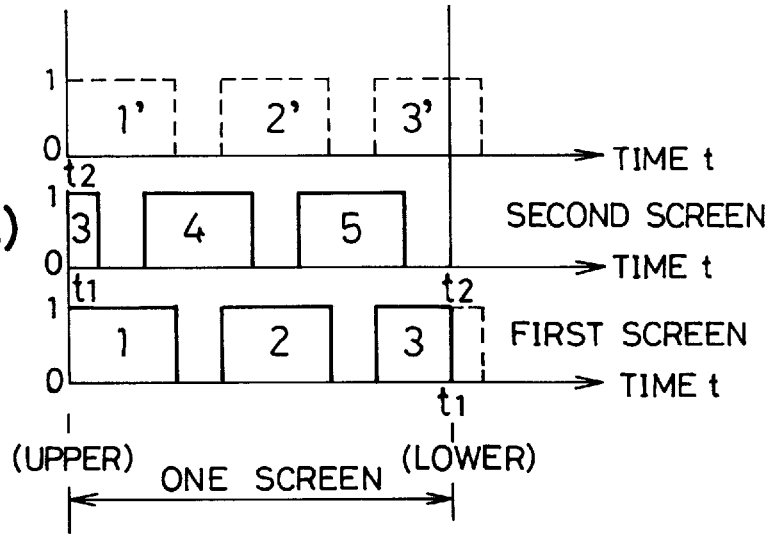
FIG. 14(*a*) through FIG. 14(*c*) are explanatory views for explaining a brightness and darkness pattern formed in the display screen when the PWM dimming is applied at the same timing as the PWM dimming timing shown in FIG. 11 with a duty factor altered to 70%.
Figure 14B:
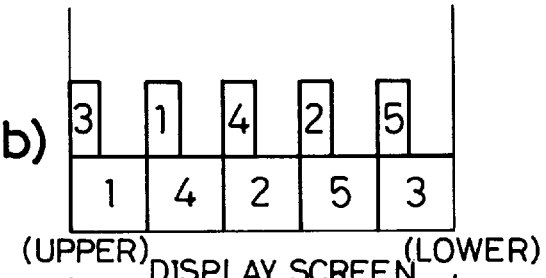
Figure 14C:
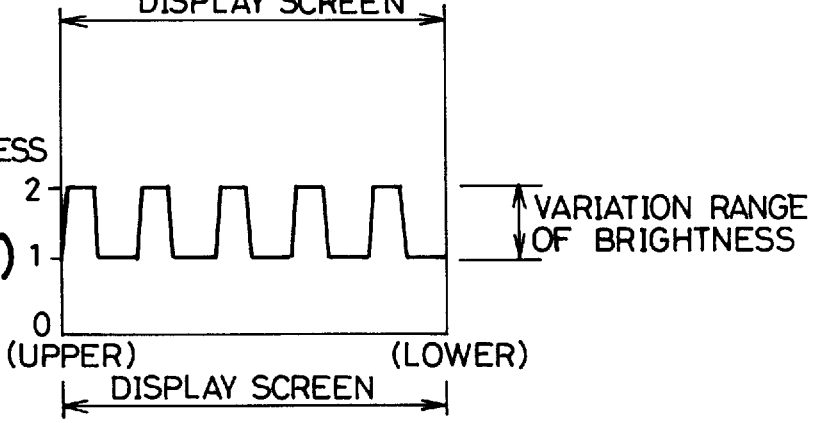
Figure 16A:
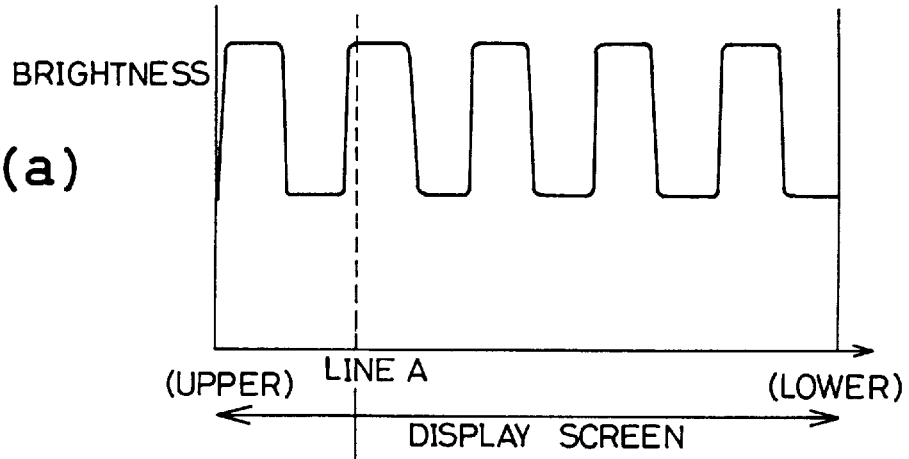
FIG. 16(*a*) and FIG. 16(*b*) are explanatory views showing an occurrence of flutter when the PWM dimming timing is not synchronized with the driving timing of the display screen at every predetermined screens.
Figure 16B:
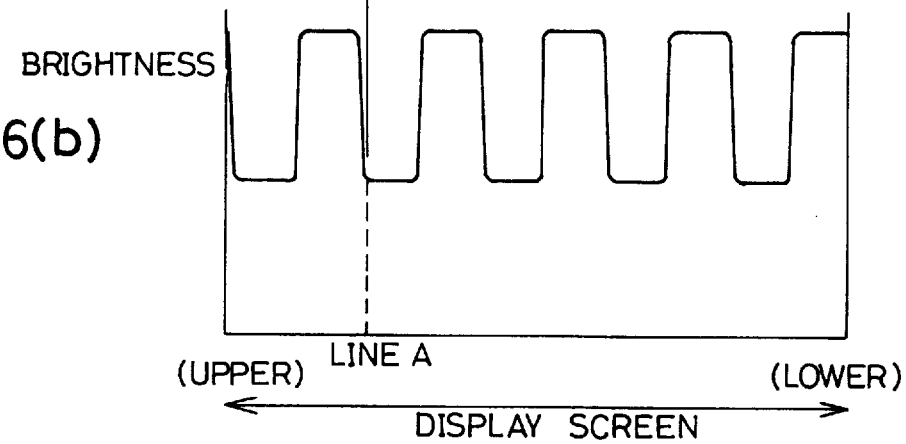

The following descriptions will discuss one embodiment of the present invention in reference to FIG. 1–3, FIGS. 4(*a*)–(*e*), FIGS. 5(*a*)–(*g*), FIGS. 6 and 7, FIG. 8(*a*) and (*b*), FIGS. 9–11, FIGS. 12(*a*)–(*c*), FIGS. 13(*a*)–(*c*), FIGS. 14(*a*)–(*c*), FIGS. 15(*a*)–(*d*), FIGS. 16(*a*) and (*b*) and FIGS. 17(*a*)–(*g*).

As illustrated in FIG. 1, a liquid crystal display with a back-light control function in accordance with the present embodiment includes a liquid crystal module 1, an image processing/system control section 2 and a display panel illuminator 3.

For the liquid crystal module 1, a picture element driving-use active element of an active matrix driving system using a TFT (Thin Film Transistor) can be used. The liquid crystal module 1 includes a liquid crystal panel 1*a* (liquid display panel), a liquid crystal driver 1*b* (display panel driving means) for driving the liquid crystal panel 1*a* and a liquid crystal panel control section 1*c* for controlling the display of the liquid crystal panel 1*a* through the liquid crystal driver 1*b*.

The liquid crystal panel 1*a* includes a transparent TFT substrate wherein plural TFTs are formed in a matrix form, a transparent counter substrate formed so as to face the TFT substrate, a liquid crystal which is sealed between the TFT substrate and the counter substrate, etc. On the TFT substrate, plural band-like signal electrodes composed of a transparent electrically conductive film and plural gate electrodes are formed at right angle. At an intersection between the signal electrodes and the gate electrodes on the TFT substrate, a picture electrode composed of the TFT and the transparent electrically conductive film is provided. In the picture electrode, a source of the TFT is connected to a signal electrode, and its drain is connected to a picture element electrode, further its gate is connected to a gate electrode. On the counter substrate, a counter electrode composed of a transparent electrically conductive film is formed. The picture element electrodes, the counter electrodes and the liquid crystals sandwiched between the picture electrodes and the counter electrodes constitute a picture element. As a display system for the liquid crystal panel 1*a*, a normally black type (negative display type) is adopted. The normally black type system suggests such that the liquid crystal panel 1*a* is set in the non-transmissive mode under the normal condition (power OFF position) and set in the transmissive mode having a signal supplied to the picture element.

The liquid crystal driver 1*b* is composed of a source driving circuit $1b_1$ connected to the signal electrode of the liquid crystal panel 1*a*, and a gate driving circuit $1b_2$ connected to the gate electrode. The display driving system for the liquid crystal driver 1*b* will be explained through the case of the linear sequential scanning system for sequentially scanning by non-interlacing from the top end line to the bottom end line on the screen for simplification.

The image processing/system control section 2 includes an image processing circuit 2*a* and a system control circuit 2*b* (light-on period setting means). The image processing circuit 2*a* is provided for converting an input video signal $V_{BS}$ such as a television signal, etc., into a signal of a suitable form to be processed in the liquid crystal module 1. The system control circuit 2*b* is composed of a micro computer, and controls respective sections in the device according to the operation by the operation section (not shown) in the liquid crystal display. For example, the system control circuit 2*b* controls the display panel illuminator 3 so as to vary the brightness of the display surface according to a brightness adjusting operation by the user.

The image processing circuit 2*a* fetches video signals $V_R$, $V_G$ and $V_B$ divided into three primary colors (R, G and B) and a composite synchronizing signal $C_{sy}$ from an input video signal $V_{BS}$ to be outputted to the liquid crystal module 1. The image processing circuit 2*a* also determines whether the input video signal VBS is of the NTSC system or the PAL system, and outputs a discrimination signal N/P (NTSC system: "H" level, PAL system: "L" level) to the liquid crystal module 1.

The liquid crystal panel control section 1*c* of the liquid crystal module 1 includes a liquid crystal panel synchronization generating section 1*d* (vertical synchronizing signal generation means and horizontal synchronizing signal generation means) for forming a display panel vertical synchronizing signal $V_{sy}$ and a display panel horizontal synchronizing signal $H_{sy}$ based on the composite synchronizing signal $C_{sy}$. The liquid crystal panel control section 1*c* outputs synchronizing signals $V_{sy}$ and $H_{sy}$ to the gate driving circuit $1b_2$ of the liquid crystal driver 1*b*. The liquid crystal panel control section 1*c* also outputs the video signals $V_R$, $V_G$ and $V_B$ and a source clock pulse CK to the source driving circuit $1b_1$. While sequentially scanning the gate electrode of the liquid crystal panel 1*b* based on respective synchronizing signals $V_{sy}$ and $H_{sy}$ (while turning ON respective TFTs on the scanning line by sequentially outputting a gate signal to a gate electrode), source signals corresponding to the video signals $V_R$, $V_G$ and $V_B$ are supplied to the signal electrode of the liquid crystal panel 1*a* so as to display on the liquid crystal panel 1*a*.

The liquid crystal module 1 includes respective output terminals of the display panel vertical synchronizing signal $V_{sy}$, the display panel horizontal synchronizing signal $H_{sy}$ and the discrimination signal N/P. From the liquid crystal module 1, the display panel vertical synchronizing signal $V_{sy}$ and the display panel horizontal synchronizing signal $H_{sy}$ are outputted to the image processing circuit 2*a* of the image processing/system control section 2. The display panel vertical synchronizing signal $V_{sy}$, the display panel horizontal synchronizing signal $H_{sy}$ and the discrimination signal N/P are outputted from the liquid module 1 to the display panel illuminator 3.

The display panel illuminator 3 mainly includes a fluorescent tube 4 (light source), an inverter section 5 (light source driving means), a back-light power supply section 6 and a PWM dimmer driving circuit section 7 (dimming means). The fluorescent tube 4 is formed on the back surface of the display panel. The inverter section 5 is provided for driving the fluorescent tube 4 by applying thereto a voltage. The PWM dimmer driving circuit section 7 is provided for performing the PWM dimming by controlling the operation of the inverter section 5.

The following description discusses the basic mechanism of the present invention in reference to FIG. 7. In the figure, the duty factor of the lighting frequency is set to 40%.

In the PWM dimming system, the fluorescent tube 4 periodically repeats turning on and off the fluorescent tube 4. In this system, if the correlation between the PWM dimming lighting frequency $f_{sw}$ and a vertical synchronizing frequency $f_v$ of the liquid crystal panel 1*a* satisfies the condition $f_{sw} \geqq f_v$, light and darkness are always formed on a time axis when considering one screen only (one vertical period). The display on the liquid crystal panel 1*a* is formed by forming plural sequential screens in predetermined vertical periods. Therefore, when the mechanism is applied to the case of plural screens, when the PWM dimming timing (lighting timing) satisfies a certain condition with respect to the vertical frequency, a predetermined light and darkness pattern is formed on a plane as explained below. For convenience, the explanations will be given through the case of the PWM dimming frequency with respect to the two screens (two vertical periods).

First, the explanation will be given through the case of adopting such a PWM dimming frequency that a flash occurs even number of times in two vertical periods, i.e., the correlation between the PWM dimming lighting frequency $f_{sw}$ and the vertical synchronizing frequency $f_v$ satisfies the condition of:

$$f_{sw}=n_1 \cdot f_v \text{ (n}_1\text{ is a positive integer).}$$

As one example which satisfies the above-noted condition, the case where six flashes occur in two vertical periods is shown in FIG. 7. In the figure, "1" on the vertical axis indicates the light-on state, while "0" on the vertical axis indicates the light-out state. As shown in FIG. 8(*a*), light-on portions (1, 2 and 3) on the first screen and light-on portions (4, 5 and 6) on the second screen are completely overlapped. Here, the light-on portion indicates an area in the display screen where a scanning is carried out in the light-on period of the back-light. Namely, in every screen, while scanning from the top end line to the $H_1$ line, from the $H_2$ line to the $H_3$ line and from the $H_4$ line to the $H_5$ line, the back-light flashes, and while scanning other lines, the back-light is turned out.

FIG. 8(*b*) shows a change in brightness in the display screen in the described state where three flashes occur in two vertical periods.

For convenience in explanation, non-unit scales "0", "1" and "2" are denoted by the non-unit scale on the vertical axis of FIG. 8(*b*). In the figure, "0" indicates that no flash occurs in two vertical periods, and "1" and "2" respectively indicate that the flash occurs once and twice. The same scales are denoted also in FIG. 12(*c*), FIG. 13(*c*), FIG. 14(*c*) and FIG. 15(*d*).

Figure 9:
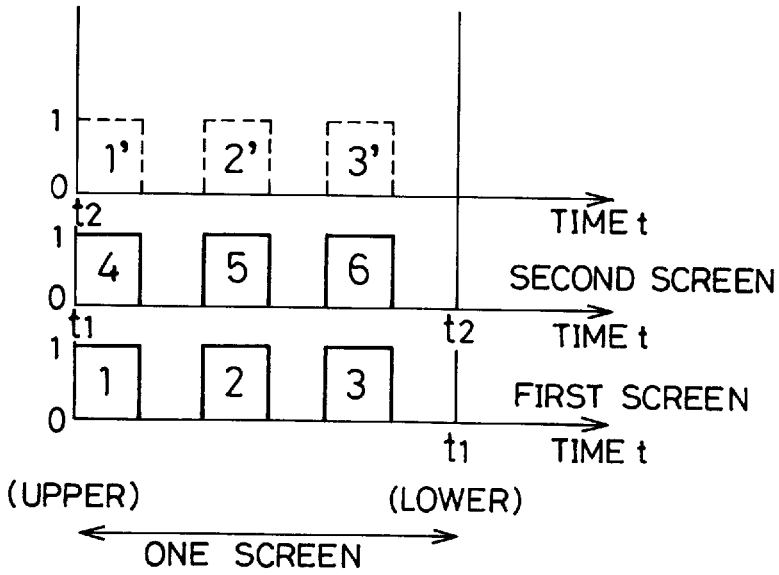
FIG. 9 PRIOR ART
FIG. 9 is an explanatory view for explaining a brightness and darkness pattern formed in the display screen at the same timing as the PWM dimming timing shown in FIG. 7 with a duty factor altered to 50%.
Figure 10:
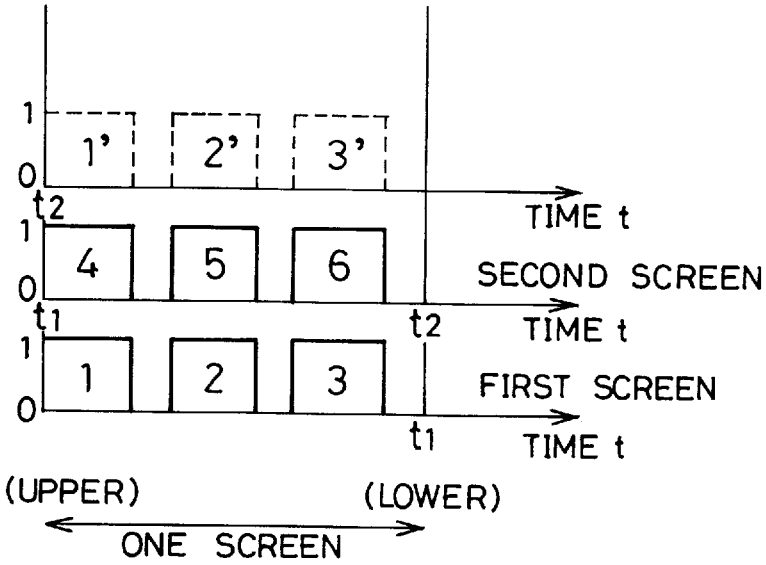
FIG. 10 PRIOR ART
FIG. 10 is an explanatory view for explaining a brightness and darkness pattern formed in the display screen at the same timing as the PWM dimming timing shown in FIG. 7 with a duty factor altered to 70%.

FIG. 9 shows the case of adopting the same PWM dimming timing as the above-mentioned case with a duty factor of 50%, and FIG. 10 shows the case of adopting the same PWM dimming frequency as the above-mentioned case with a duty factor of 70%. As shown in these figures, in the case of adopting such a PWM dimming frequency that a flash occurs even number of times in two vertical periods, even if the duty factor is changed, the brightness changes into two levels, i.e., "0" (no flash occurs in two vertical periods) and "2" (two flashes occur in two vertical periods. Namely, the change in variation between "0" and "1" (shown in FIG. 12(*c*)), no change in variation (always "1" level) (shown in FIG. 13(*c*)), the change in variation between "1" level and "2" level (shown in FIG. 14(*c*)), and the change in variation "0", "1", "2", "1" and "0" in this order (shown in FIG. 15(*d*)) will not occur. Therefore, always a sudden change in brightness occurs between the minimum level "0" and the maximum level "2" and the change is visible.

The next explanations will be given through the case of adopting such a PWM dimming frequency that a flash odd number of times (at least three times) in two vertical periods, i.e., the relationship between the PWM dimming lighting frequency $f_{sw}$ and the vertical synchronizing frequency $f_v$ satisfies the condition of:

$$f_{sw}=(2n_2+1) \cdot f_v/2 \text{ (n}_2\text{ is a positive integer).}$$

As one example of the case of satisfying the above condition, the case of adopting such a frequency that five flashes occur in two vertical periods as shown in FIG. 11. In the figure, "1" on the vertical axis indicates the light-on state, while "0" on the vertical axis indicates the light-out state, and the duty factor for the lighting frequency is set to 40%. In this case, as shown in FIG. 12(*a*), light-on portions (1, 2 and 3) on the first screen and light-on portions (4 and 5) on the second screen are not overlapped. Namely, when the duty factor is set to not more than 50%, in the area where a scanning is performed in the flashing period (lines in the area) in the previous screen, the scanning is performed in the light-out period in the next screen. In FIG. 12(*b*), the time axes of the first screen and the second screen in FIG. 12(*a*) are overlapped to indicate while scanning which portion in the display screen in two vertical lines, the back-light flashes. As shown in FIG. 12(*b*), the light-on portions in the second screen are inserted into the center of the light-out portions in the first screen.

Each scanning line in the display screen is subject to two scanning operations in two screens (two vertical periods), and two signals are written in each picture element. In this case, five bright portions in which the back-light flashes while scanning either one of the two screens (in the state where each picture element shows the highest transmittance) are separated from 5 dark portions in which the back-light is turned out while scanning either one of the screens. Therefore, the difference in brightness occurs between the bright portions and the dark portions, i.e., user feels the bright portions still brighter than the dark portions. This change in brightness occurs at a predetermined frequency according to the number of bright portions and the number of dark portions in the display screen. The variations in brightness in the display screen is shown in FIG. 12(*c*).

In the described example, the variation range in brightness between the bright portions and the dark portions is one half of the case of adopting the PWM dimming where a flash occurs even number of times in two vertical periods (see FIG. 8(*b*) and FIG. 12(*c*)) for the following reason. Namely, in the case of adopting such a lighting frequency that the back-light flashes even number of times in two vertical periods, the back-light flashes the bright portions while scanning either one of the two screens, while the back-light flashes the bright portions only while scanning either one of the two screens.

Additionally, in the above-mentioned case, the frequency of the change in brightness is two times as large as that of the case of adopting such a PWM dimming frequency that the back-light flashes even number of times in two vertical periods. Namely, a flash occurs even number of times $n_e$ in two vertical periods (six times in FIG. 8(*a*)), the bright portions and the dark portions are respectively formed in the number of ($n_e/2$) (three in FIG. 8(*b*)). On the other hand, when a flash occurs odd number of times $n_o$ of at least three (five times in FIG. 12(*a*)), bright portions and the dark portions are formed in the number of n (five in FIG. 12(*a*)) in the display screen (see FIGS. 8(*b*) and FIG. 12(*c*)).

As described, in the case of adopting the PWM dimming where a flash occurs odd number of times (at least three times) in two vertical periods, the variation range of the brightness in the display screen can be reduced to one half and the frequency of the variation in brightness can be made as two times as large as the case of adopting the PWM dimming where a flash occurs even number of times in two vertical periods. As a result, the flicker can be reduced significantly (around ¼).

The described example has been given through the case where the duty factor of the PWM dimming where a flash occurs odd number of times (at least three times) in two vertical periods is set to 40%. However, with the duty factor of at least 50%, the same effect of preventing an occurrence of flicker can be achieved as explained below.

FIG. 13(*a*) through FIG. 13(*c*) show the case of adopting such a frequency that a flash occurs five times in two vertical periods with the duty factor of 50%. In this example, as shown in these figures, the light-on portions (1, 2 and 3) in the first screen and the light-out portions in the second screen are completely overlapped, and the light-out sections on the first screen and the light-on portions (4 and 5) on the second screen are completely overlapped. Therefore, the bright portions and the dark portions are not formed in the display screen, thereby achieving a substantially uniform brightness on the entire surface of the display screen as shown in FIG. 13(*c*). As a result, an occurrence of flicker can be prevented.

Another example of adopting such a lighting frequency that five flashes occur in two vertical periods and a duty factor of 70% is shown in FIG. 14(*a*) through FIG. 14(*c*). As shown in FIG. 14(*a*) and FIG. 14(*b*), there exists an area where the light-on portions on the first screen and the light-on portions on the second screen are overlapped. However, the light-out portions on the first screen and the light-out portions on the second screen are not overlapped. In this example, as shown in FIG. 14(*c*), five bright portions in which the back-light flashes both while scanning the first screen and the second screen (the state where each picture element shows the highest transmittance) are separated from five dark portions in which the back-light flashes only while scanning either one of the two screens. The variation range of brightness between the bright portions and the dark portions in this example is the same as that in the case where the duty factor is not more than 50% (see FIG. 12(*c*) and FIG. 14(*c*)). Therefore, an occurrence of flicker can be suppressed by the same mechanism as the case of adopting the duty factor of not more than 50%.

The explanations have been given through the case of two vertical periods only. However, the same mechanism can be applied to the case with respect to three or more vertical periods. For example, in the case of adopting such a PWM dimming frequency that a flash occurs a multiple of 3 times (3, 6, 9, . . . ) in three vertical periods, light-on portions are completely overlapped in all screens, and the same bright and darkness pattern as the case of adopting such a frequency that a flash occurs even number of times in two vertical periods is formed on the display screen. On the other hand, in the case of adopting the PWM dimming frequency where a flash does not occur a multiple of three times (at least four times) in three vertical periods (4, 5, 7, . . . ), with a basic unit of three vertical periods, the variation range of the brightness on the display screen and the bright and darkness pattern with a high frequency of variation in brightness can be achieved compared with the case of adopting such a frequency that a flash occurs a multiple of 3 times in three vertical periods as in the case of adopting such a frequency that a flash occurs odd number of times (at least 3) in two vertical periods.

Namely, by adopting such a PWM dimming frequency such that a flash occurs m times (m is an integer of not less than n, and not a multiple of n) in n vertical periods (n is an integer of at least 2), an occurrence of flicker can be effectively prevented. Here, the conventional example of the PWM dimming where $f_{sw}=F_v$, $f_{sw}$: the PWM dimming lighting frequency, $f_v$: vertical synchronizing frequency, explained under the prior art section corresponds to the example where a flash occurs two times (even number of times) in two vertical scanning periods.

FIG. 15(*a*) through FIG. 15(*d*) show a case of adopting such a frequency that a flash occurs 5.6 times in two vertical periods with the duty factor of 50% as an example of the case where the number of flashes in two vertical periods is not an integer. In FIG. 15(*a*) and FIG. 15(*b*), the time axis of the first screen and the time axis of the second screen are overlapped. In FIG. 15(*c*), the time axis of the third screen and the time axis of the fourth screen are overlapped. FIG. 15 (*d*) shows the variation in brightness in the display screen corresponding to FIG. 15(*c*). In this case, the bright portion, the dark portion and the intermediate portion vary in proportion so as to be shifted at a predetermined pattern although a fixed brightness and darkness pattern is not formed. More specifically, in the bright portions, the back-light flashes while scanning either one of the two screens. In the dark portions, the back-light is turned off both while scanning the first screen and the second screen. In the intermediate portions, the brightness is in an intermediate level between the bright portions and the dark portions, and the back-light flashes while scanning either one of the two screens. In this case, variations in the range of brightness on the display screen is larger than the case where a flash occurs odd number of times (at least three times) in two vertical periods.

The lighting frequency where a flash occurs 5.6 times in two vertical periods is equivalent to the lighting frequency where a flash occurs 14 times in five vertical periods. Therefore, with a unit of five vertical periods, the variation range of the brightness in the display screen is small, and the effect of preventing the flicker can be expected. However, when viewing with a unit of 2–4 screens, a large variation in brightness is shown in the display screen. Moreover, the frequency of variation in brightness is low. More concretely, when adopting the NTSC system, the vertical synchronizing frequency is 60 Hz. Thus, the PWM dimming frequency is 168 Hz, and the frequency of the fixed brightness and darkness pattern to be repeated at every five vertical synchronizing periods is 12 Hz. In general, the change in brightness occurs with a frequency obtained by dividing the PWM dimming frequency $f_p$ by a common divisor of the vertical synchronizing frequency $f_v$ and the PWM dimming frequency $f_p$. In the case where the number of flashes in two vertical periods is not an integer like the case of 5.6 flashes occur in two vertical periods, the frequency of change in brightness is low, and the variation range in brightness is large, thereby easily detecting the occurrence of flicker. For the above-mentioned reason, the largest effect of preventing an occurrence of flicker can be achieved when adopting such a frequency that a flash occurs odd number of times (at least three times) in two vertical periods.

As described, by setting the PWM dimming frequency according to the vertical driving frequency on the display screen, an occurrence of flicker can be effectively prevented. However, even when the correlation between the PWM dimming frequency and the driving frequency on the display screen is slightly displaced from the described relationship (i.e., a flash occurs m times (m is an integer of not less than n and not a multiple of n)) in n vertical periods (n is an integer of not less than 2), flutter may occur depending on the pattern displayed on the screen with a period (around 1–10 seconds) longer than the period of variation in brightness of the flicker. In the correlation between the PWM dimming frequency $f_p$ and the vertical synchronizing frequency $f_v$, in the case where the vertical synchronizing frequency $f_v$ is set to 60 Hz, and 5.01 flashes occur in two vertical periods (which is slightly different from 5 (by 0.01)), the PWM dimming frequency $f_p$ becomes 150.3 Hz. In this case, the period of the difference is 1/0.3=3.3 (second), and the fixed brightness and darkness pattern is repeated at every 3.3 seconds, which causes flutter. The flicker refers to the variation of relatively high frequency, and the flutter refers to the variation of relatively low frequency. People perceive the flutter when the following three factors satisfy certain conditions: variation in transmittance of the liquid crystal panel 1*a*, dimming frequency and dimming duty of the PWM dimming.

The flutter will be explained below in reference to FIG. 17(*a*) through FIG. 17(*g*).

In FIG. 17(*a*) through FIG. 17(*g*), the time period from $t_0$ to $t_2$ corresponds to one screen period (one vertical period). $t_0$ suggests a start of each screen, and $t_2$ suggests the end of each screen, and the state at to and the state at $t_2$ are equivalent. Namely, the time axes of sequential two screens are overlapped in FIG. 17(*a*) through FIG. 17(*g*).

For comparison with the liquid crystal panel screen, FIG. 17(*a*) shows the change in brightness of the scanning line in the CRT screen as time passes. Here, the explanations will be given through the case of the non-interlaced CRT screen. In the CRT screen, the peak brightness on the scanning line is shown when scanning by an electron beam. Thereafter, the brightness on the scanning line is lowered to almost zero until the scanning of the next screen by the electron beam is started.

FIG. 17(*b*) shows variations in light transmittance of the scanning line as time passes, in the liquid crystal screen of the active matrix driving system adopting the picture element driving active element such as TFT, etc., as in the aforementioned case. Additionally, when the brightness of the back-light is flat (no variation occurs in the panel and the time axis), a variation in brightness of the scanning line in the liquid crystal panel screen is shown. When scanning ($t_1$), the light transmittance on the scanning line is at a peak point, and thereafter, the light transmittance on the scanning line is gradually lowered until the next scanning operation (next screen) is started. The changes in light transmittance on the liquid crystal panel screen is very little compared with that on the CRT screen shown in FIG. 17(*a*). However, to show that the light transmittance changes, an enlarged scale is used on the vertical axis in FIG. 16(*b*).

Flatter will be explained in reference to FIG. 17(*c*) which is an enlarged view of FIG. 17(*b*) on the vertical axis.

FIG. 17(*d*) and FIG. 17(*e*) show changes in brightness as time passes of the back-light itself subject to the PWM dimming. Without synchronizing the PWM dimming timing with the driving timing of the display screen, it is difficult to prevent the phase change of the PWM dimming at a frequency of 1 to 10 seconds from the phase shown in FIG. 17(*d*) to the phase shown in FIG. 17(*e*), or vice versa. In FIG. 17(*d*), the brightness of the back-light is high when a scanning operation is performed (at time $t_1$). On the other hand, in FIG. 17(*e*), the brightness of the back-light is low when the scanning operation is performed (at time $t_1$).

FIG. 17(*f*) is a combination of FIG. 17(*c*) which is an enlarged diagram showing the variation in transmittance of the liquid crystal panel and FIG. 17(*e*) which shows the variation in brightness of the scanning line on the liquid crystal panel screen in the case of performing the PWM dimming with the phase shown in FIG. 17(*d*). In this case, when the light transmittance changes from the minimum to the maximum (t 1 at which scanning is performed), as the brightness of the backlight is high, a variation in brightness occurs in the liquid crystal display at t.

In FIG. 17(*g*), FIG. 17(*c*) in which the changes in light transmittance on the liquid crystal panel are shown by the enlarged scale and FIG. 17(*e*) are combined. FIG. 17(*g*) shows changes in brightness on a certain scanning line on the liquid crystal panel screen in the case where the PWM dimming is performed with the phase shown in FIG. 17(*e*). In this case, when the light transmittance changes from the minimum value to the maximum value (time $t_1$ at which the scanning is performed), since the brightness of the back light is low, the brightness of the liquid crystal display changes but very little. Thereafter, at $t_1$ at which the brightness of the back-light becomes high, the brightness of the liquid crystal display changes largely.

As described, without synchronizing the PWM dimming timing with the driving timing of the display screen, as shown in FIG. 17(*d*) and 17(*e*), a phase difference of the PWM dimming of the back-light occurs. As a result, a timing at which the brightness of the liquid crystal display changes varies as shown in FIG. 17(*f*) and FIG. 17(*g*). Although the phase difference between FIG. 17(*d*) and FIG. 17(*e*) is 180°, if the period at which the phase shift of 180° occurs is T, the flutter generates at a period of 2T.

The fluttering phenomenon appears also in the following case. For example, in the case where the brightness distribution of an up-down direction (vertical direction) on a screen is as shown in FIG. 16(*a*) wherein the line A in the screen falls in a bright portion, it is difficult to always maintain the relationship between the PWM dimming frequency and the driving frequency of the display screen. Even if the relationship slightly goes outside the described condition, the displacement of the brightness distribution pattern (brightness and darkness pattern) on the display screen becomes larger in the time axis direction, and after the elapse of time T, a phase difference of 180° occurs. As a result, a brightness distribution pattern where the line A falls in a dark portion is formed as shown in FIG. 16(*b*), i.e., the variation in brightness is generated at a period of 2T. In this case, people perceive flutter wherein a variation in brightness occurs at a period of 1–10 seconds.

The described flutter phenomenon can be prevented by synchronizing the PWM dimming timing with the vertical driving timing of the display screen at every predetermined screens.

The PWM dimmer driving circuit section 7 of the present embodiment performs the PWM dimming with such a frequency that five flashes occur in two vertical periods and synchronizes the PWM dimming timing with the driving timing of the display screen at every two vertical periods as explained below.

Figure 2:
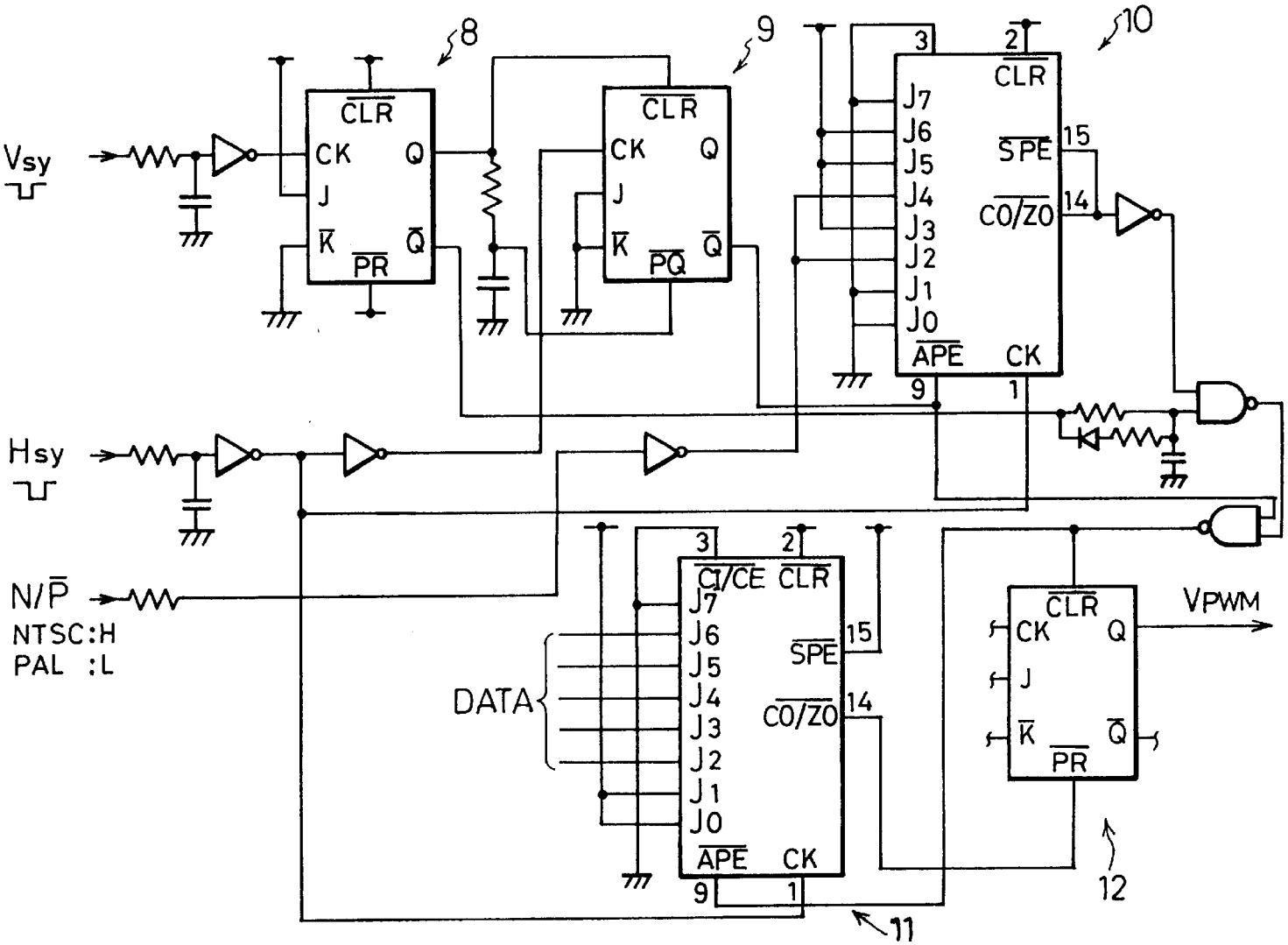
FIG. 2 is a schematic circuit diagram showing a structure of a PWM dimmer driving circuit section of the liquid crystal display as one example.

As illustrated in FIG. 1, the PWM dimmer driving circuit section 7 includes a one-half dividing circuit 8, synchronizing set/reset circuit 9, a two-fifths vertical period dividing circuit 10 (dividing means), a pulse count circuit 11 (counting means) and a PWM dimmer lighting pulse generating circuit 12. The one-half dividing circuit 8 is provided for dividing a frequency of the vertical synchronizing signal $V_{sy}$ into half. The synchronizing set/reset circuit 9 is provided for outputting a synchronizing pulse 2Tv with a pulse width of one horizontal pulse at every two vertical periods based on an output from the one-half dividing circuit 8 and a display panel horizontal synchronizing signal $H_{sy}$. The two-fifths vertical period dividing circuits 10 (dividing means) is provided for generating a pulse signal ⅖ Tv with a frequency for dividing the two vertical periods by five based on the discrimination signal N/P, the synchronizing pulse 2Tv and the display panel horizontal synchronizing signal $H_{sy}$. The pulse count circuit 11 (count means) is reset by the signal ⅖ Tv, and thereafter counts the display panel horizontal synchronizing signals $H_{sy}$ of a number set by a dimming digital control signal DATA from the system control circuit 2*b* to form a reset pulse $P_R$. The PWM dimmer lighting pulse generating circuit 12 is provided for generating a PWM dimmer lighting pulse $V_{PWM}$ which determines the light-on period of the back-light based on the signal ⅖ Tv and the reset pulse $P_R$. A structure of one example of the PWM dimmer driving circuit section 7 is shown in FIG. 2.

The half dividing circuit 8 and the synchronizing set/reset circuit 9 constitute synchronization means recited in claims of the present invention.

In the NTSC system which is adopted as a regular television broadcasting system, two vertical periods corresponds to 525 horizontal periods. In the PAL system, two vertical periods correspond to 625 horizontal periods, and the number of pulses of the horizontal synchronizing signal in two vertical periods is fixed. Therefore, two-fifths vertical period dividing circuit 10 achieves the PWM dimming frequency by dividing the frequency of the horizontal synchronizing signal. In the present embodiment, such a PWM dimming frequency that 5 flashes occur in two vertical periods is adopted simply because the number 5 is a common divisor of 525 and 625. The number 25 is also a common divisor of 525 and 625, which is not smaller than 3. However, it is not appropriate to set to such a frequency that 25 flashes occur in 2 vertical periods as the lighting frequency is too high. The two-fifths vertical period dividing circuit 10 achieves the PWM dimming frequency by dividing the frequency of the horizontal synchronizing signal by 105 in the case of adopting the NTSC system, while achieves the PWM dimming frequency by dividing the frequency of the horizontal synchronizing signal by 125 in the case of adopting the PAL system. Therefore, the lighting frequency in the NTSC system is set to 150 Hz, and the lighting frequency in the PAL system is set to 125 Hz.

Figure 3:
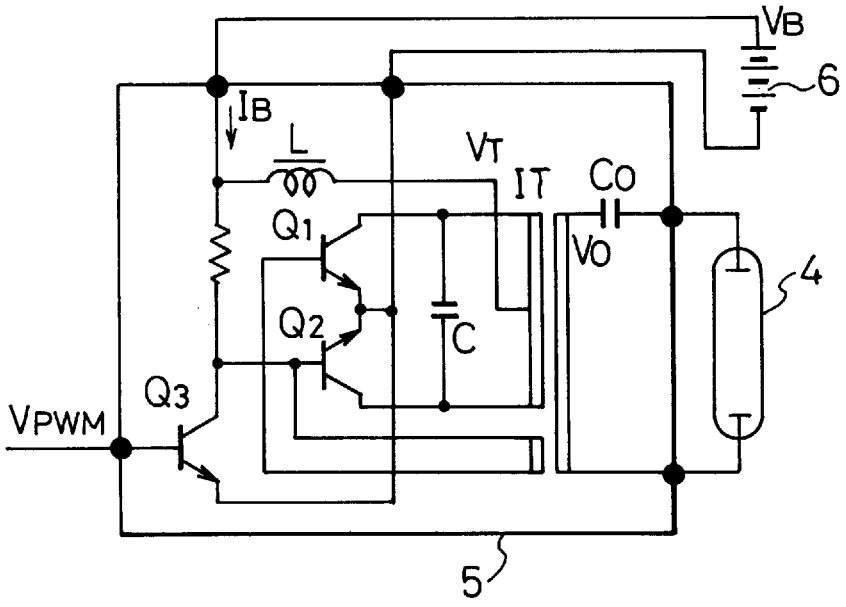
FIG. 3 is a schematic circuit diagram showing a structure of an inverter section of the liquid crystal display as one example.

As illustrated in FIG. 3, the inverter section 5 is a self-exited oscillating circuit of a voltage resonance type. The inverter section 5 basically includes a constant current inductance coil L (choke coil), an inverter transformer IT, a resonance condenser C, transistors $Q_1$ and $Q_2$ for use in a push-pull switching operation, a drive control transistor $Q_3$ for the transistors $Q_1$ and $Q_2$ and a constant current ballast condenser $C_0$.

For the fluorescent tube 4, the CCFT (Cold Cathode Fluorescent Tube) is adopted.

In the described arrangement, the following descriptions will discuss the operation of the liquid crystal display.

As illustrated in FIG. 1, when a video signal VBS (see FIG. 4(*a*)) of a television signal of the NTSC system or the PAL system is inputted from an external device such as a television receiver, a video tape recorder (VTR), etc., into the image processing/system control section 2 of the liquid crystal display, first, the image processing circuit 2*a* of the image processing/system control section 2 separate the video signal $V_{BS}$ into the video signals $V_R$, $V_G$ and $V_B$ (see FIG. 4(*d*)) and the composite synchronizing signal $C_{sy}$ (see FIG. 4(*b*)). Then, the video signals $V_R$, $V_G$, $V_B$ and the composite synchronizing signal $C_{sy}$ are outputted to the liquid crystal module 1. The video signal processing circuit 2*a* also outputs the discrimination signal N/P which determines whether the video signal $V_{BS}$ is of the NTSC system or of the PAL system to the liquid crystal module 1.

In the liquid crystal module 1, the liquid crystal panel synchronization generating section 1*d* generates the display panel vertical synchronizing signal $V_{sy}$ (see FIG. 4(*c*)) and the display panel horizontal synchronizing signal $H_{sy}$ (see FIG. 4(*e*)) based on the composite synchronizing signal $C_{sy}$ to be outputted to the PWM dimmer driving circuit section 7 of the display panel illuminator 3. Also, the discrimination signal N/P is outputted to the PWM dimmer driving circuit section 7 from the liquid crystal module 1.

In the PWM dimmer driving circuit section 7, the one-half dividing circuit 8 divides the frequency of the display panel vertical synchronizing signal $V_{sy}$ (see FIG. 5(*a*)) of the frequency $f_v$ (NTSC system: 60 Hz, PAL system: 50 Hz) from the liquid crystal module 1 into half, and outputs a signal $S_R$ (see FIG. 5(*b*)) of the frequency fv/2 (NTSC system: 30 Hz, and the PAL system: 25 Hz) to the synchronizing set/reset circuit 9.

The synchronizing set/reset circuit 9 is composed of a synchronizing monostable multivibrator. The synchronizing set/reset circuit 9 generates a synchronizing pulse 2Tv (see FIG. 5(*c*)) with a pulse width of one horizontal period (1 H) at every two vertical periods based on the output signal $S_R$ from the synchronizing set/reset circuit 9 and the display panel horizontal synchronizing signal $H_{sy}$ (see FIG. 5(*d*)) from the liquid crystal module 1, to be outputted to the two-fifths vertical period dividing circuit 10.

The two-fifths vertical period dividing circuit 10 includes a down counter with a reset function (for example 74HC40103 shown in FIG. 2) for switching the counter set value between 105 and 125 based on the discrimination signal N/P from the liquid crystal module 1. The two-fifths vertical dividing circuit 10 is reset by the synchronizing pulse 2Tv from the synchronizing set/reset circuit 9. The two-fifths vertical period dividing circuit 10 is also reset by itself at every 105 horizontal periods in the NTSC system and at every 125 horizontal periods in the PAL system to divide the frequency of the display panel horizontal synchronizing signal $H_{sy}$ by 105 (two vertical periods correspond to 525 horizontal periods and by 125 (two vertical periods correspond to 625 horizontal periods). In the two-fifths vertical period dividing circuit 10, the reset by the synchronizing pulse 2Tv has a priority over the self reset. Namely, after the two-fifths vertical period dividing circuit 10 is reset by the synchronizing pulse 2Tv, self reset is carried out four times in total. Thereafter, the next self reset is not performed (from the fifth times), and the reset by the synchronizing pulse 2Tv is given a priority. As a result, in either case of adopting the NTSC system or the PAL system, the two-fifths vertical period dividing circuit 10 generates the pulse signal ⅖ Tv (see FIG. 5(*e*)) with 5 pulses (pulse width: the width of one horizontal period) at every two vertical periods while synchronizing at every two vertical periods. The resulting signal ⅖ Tv is outputted to the pulse count circuit 11 and to the PWM dimmer lighting pulse generating circuit 12.

The pulse count circuit 11 is composed of a down counter with a reset function (for example, 74HC40103 shown in FIG. 2). The pulse count circuit 11 sets a counter set value based on the dimmer digital control signal DATA from the system control circuit 2*b*. The pulse count circuit 11 is reset by the signal ⅖Tv from the two-fifths vertical period dividing circuit 10. The pulse count circuit 11 starts counting down based on the display panel horizontal synchronizing signal $H_{sy}$ when it is reset by the signal ⅖ Tv. The pulse count circuit 11 outputs a reset pulse $P_R$ (see FIG. 5(*f*)) when the same number of display panel horizontal synchronizing signal $H_{sy}$ as the number of counter set value are inputted thereto.

The PWM dimmer lighting pulse generating circuit 12 is set by the signal ⅖ Tv from the two-fifths vertical period dividing circuit 10, and is reset by the reset pulse $P_R$ from the pulse count circuit 11, so as to generate the PWM dimmer lightning pulse $V_{PWM}$ having a period for the number of horizontal synchronizing pulses according to the control signal DATA. The PWM dimmer lightning pulse $V_{PWM}$ is inputted to the inverter section 5 to oscillate the inverter section 5.

The inverter section 5 is set in the oscillation mode when the PWM dimmer lighting pulse $V_{PWM}$ from the PWM dimmer driving circuit section 7 is "L" level and applies a voltage to the fluorescent tube 4. On the other hand, the inverter section 5 is set in the oscillation stop mode when the PWM dimmer lighting pulse $V_{PWM}$ is "H" level.

As described, by performing the PWM dimming with a lighting frequency of five flashes in two vertical periods, an occurrence of flicker can be effectively prevented. Moreover, since the PWM dimming timing and the driving timing of the liquid crystal panel 1*a* are synchronized at every two vertical periods, an occurrence of flutter can be prevented.

The synchronization of the PWM dimming timing with the driving timing of the liquid crystal panel 1*a* is effective especially against video signals which are not of the regular broadcasting system, such as a signal resulting from special reproduction (slow motion reproduction or still reproduction, etc.) in the VTR.

In the case of video signals which are of the regular broadcasting system, such as a receiving signal for the television receiver, etc., by performing the PWM dimming based on the frequency obtained by dividing the frequency of the display panel horizontal synchronizing signal $H_{sy}$, a phase difference between the lighting period of the fluorescent tube 4 and the driving period of the liquid crystal panel 1*a* is not like to occur without applying the synchronizing process at every two vertical periods. Therefore, using the PWM dimming frequency obtained by dividing the display panel horizontal synchronizing signal $H_{sy}$, an occurrence of flutter can be effectively prevented.

However, in the case of the video signal resulting from the special reproduction in the VTR, difference in period of the synchronizing signal from the regular broadcasting system is likely to occur. This causes the number of pulses of the horizontal synchronizing signal in one vertical period to be outside the regulation. In this case, if the PWM dimming is performed only based on the frequency obtained by dividing the frequency of the display panel horizontal synchronizing signal $H_{sy}$ without applying the synchronization at every two vertical periods, a phase shift occurs between the lighting period of the fluorescent tube 4 and the driving period of the liquid crystal panel 1*a*, thereby presenting the problem that the flutter is likely to generate. In the arrangement of the present embodiment, by applying the synchronization at every two vertical periods, an occurrence of flutter can be surely prevented.

In the present embodiment, the PWM dimming lighting frequency of the NTSC system is set to 150 Hz (125 Hz in the PAL system) which is about one-half of the conventional PWM dimmer lighting frequency 300–400 Hz. Additionally, by adopting the lighting frequency of three flashes in two vertical periods, the PWM dimming lighting frequency can be still reduced. As described, the present invention not only prevents an occurrence of flicker but also offers a lower PWM dimmer lighting frequency compared with the case of adopting the conventional technique. Additionally, by reducing the PWM dimming lighting frequency, sound noise generated from the choke coil L (see FIG. 3) of the inverter section 5 can be also reduced.

Namely, when the PWM dimming lighting frequency is lowered, the basic frequency of the electromagnetic noise generated in the choke coil L can be reduced as a matter of course. The frequency of a sound wave affects the auditory sense of human being, and in general, when the frequency of the sound wave is not more than 600 Hz, a hearing difficulty occurs as the frequency of the sound wave is lowered even at the same sound level. The frequency of the basic wave of the electro-magnetic noise generated in the arrangement of the present embodiment is 150 Hz, which is one-half of the frequency 300–400 Hz of the basic wave of the conventional electro magnetic noise. Therefore, the auditory level which people perceive can be reduced to around one-half. Furthermore, as the energy generated from the sound noise by one flash is substantially constant, one-half of the PWM dimming lighting frequency brings about one-half of the total amount of energy generated from sound noise (sound level). Namely, by reducing the PWM dimming lighting frequency to around one half of the conventional level, from the point of the auditory level and the energy generated from noise, sound noise can be reduced to around one-fourth.

The brightness of the liquid crystal panel 1*a* (light-on period of the fluorescent tube 4) is set based on the control signal DATA from the system control circuit 2*b*.

In the system control circuit 2*b*, the light-on duration is set by specifying the number of pulses of the display panel horizontal synchronizing signal $H_{sy}$ in one period of the PWM dimming. Therefore, in the NTSC system, the number of pulses of the horizontal synchronizing signal $H_{sy}$ can be adjusted to 105 levels (1–105(full lighting)), while in the PAL system, the number of pulses can be adjusted to 125 levels (1–125 (full lighting)). However, in the present embodiment, the upper limit and the lower limit of the light-on duration (light-on period pulse width of the PWM dimming lighting pulse $V_{PWM}$) are set excluding the states of the full lighting and the complete light-out for the following reason.

The inverter section 5 in FIG. 3 is set in the oscillation mode when the PWM dimming lighting pulse $V_{PWM}$ from the PWM dimmer driving circuit section 7 is set in the "L" level. Thereafter, a predetermined time is required before the fluorescent tube 4 flashes for the first time by receiving an oscillation output from the inverter section 5. This mechanism will be explained in reference to FIG. 3 through FIG. 6.

The period from the time point a to the time point b in FIG. 6 is the period required for the transistors $Q_1$ and $Q_2$ to be turned ON after the PWM dimming lighting pulse $V_{PWM}$ is switched from the "H" level to the "L" level. In the period from the time point b to the time point c in FIG. 6, the inductance $L_{IT}$ of the inverter transformer IT is significantly smaller than the inductance $L_L$ of the constant current inductance coil L ($L_{IT} \ll L_L$). Therefore, during the period from the time point b to the time point c, the transformer voltage $V_T$ has the ground potential. From the time point c in FIG. 6, a voltage is applied to the inverter transformer IT, and the oscillation can be started. However, the transformer output $V_0$ obtains the oscillation wave from only after the time point d. Therefore, from the time point e, the oscillation output voltage of the inverter section 5 becomes higher than the discharging initiating voltage of the fluorescent tube 4, and the fluorescent tube 4 starts discharging. Furthermore, from the time point f, normal discharge current is obtained.

As described, even though a voltage $V_B$ is being supplied from the back-light power supply section 6 to the inverter section 5, the fluorescent tube 4 does not flash until the time point f. This means that during the described period, the power of the product of the supply current $I_B$ and the applied voltage $V_B$ from the back-light power supply section 6 is wasted. While transiting to the oscillation mode, the current $I_B$ at peak point becomes two times as high as the normal current due to transient phenomenon. Therefore, a voltage of two times as high as the normal voltage is applied to the inverter transformer IT, the resonance condenser C and the transistors $Q_1$ and $Q_2$. Therefore, a large load is incurred on these components.

Figure 21:
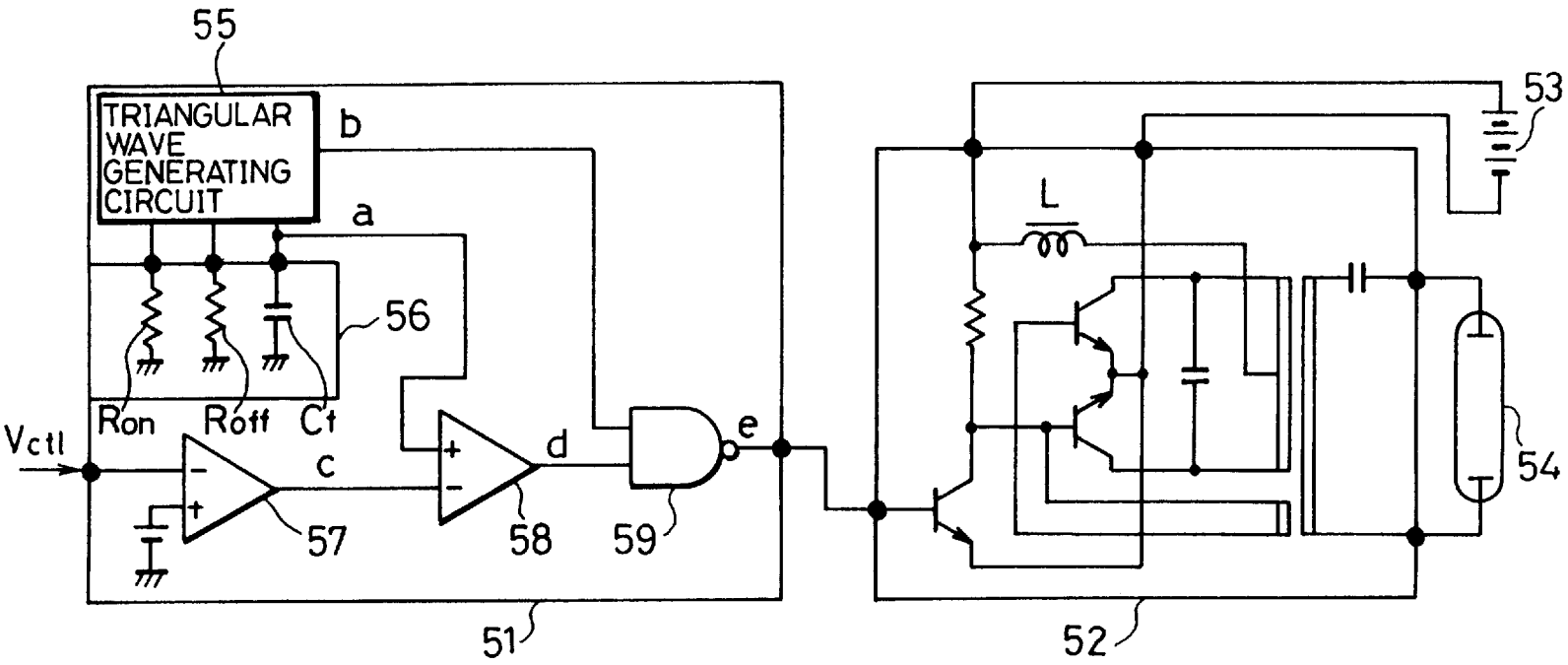
FIG. 21 PRIOR ART
Figure 23:
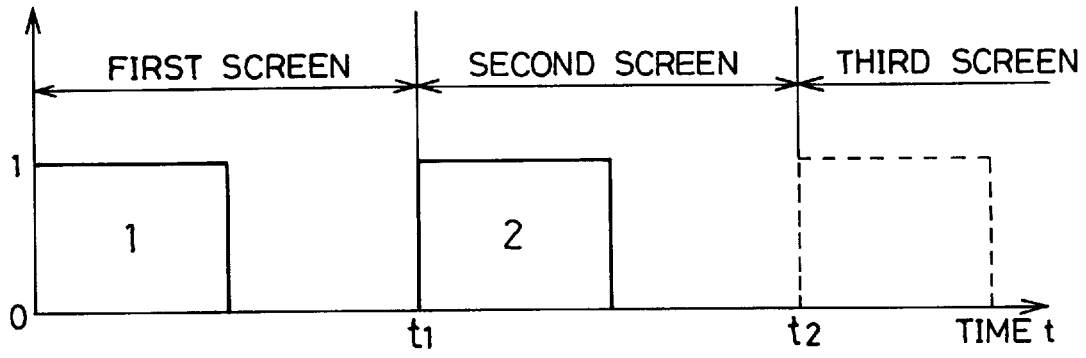
FIG. 23 PRIOR ART
Figure 24:
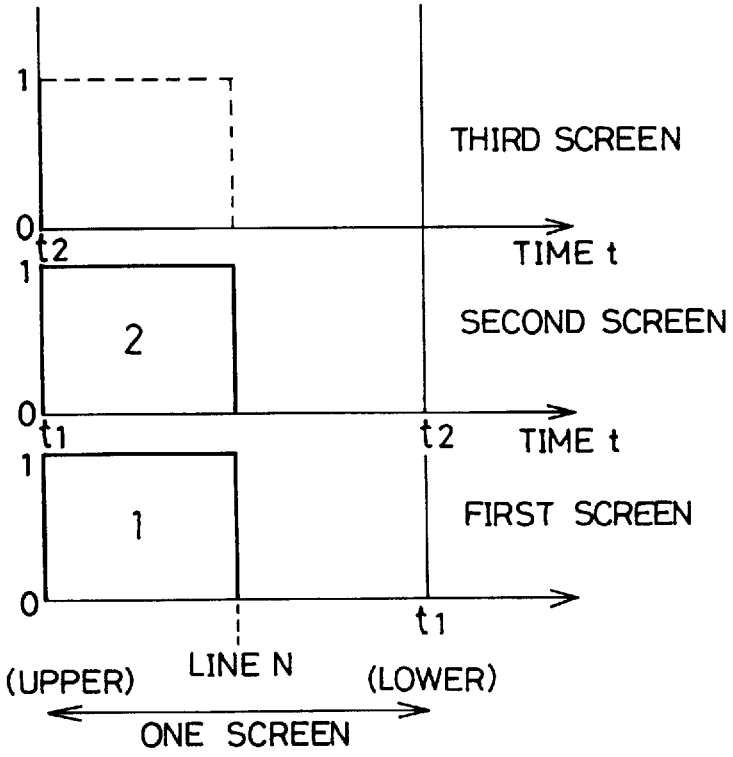
FIG.24 PRIOR ART
Figure 25:
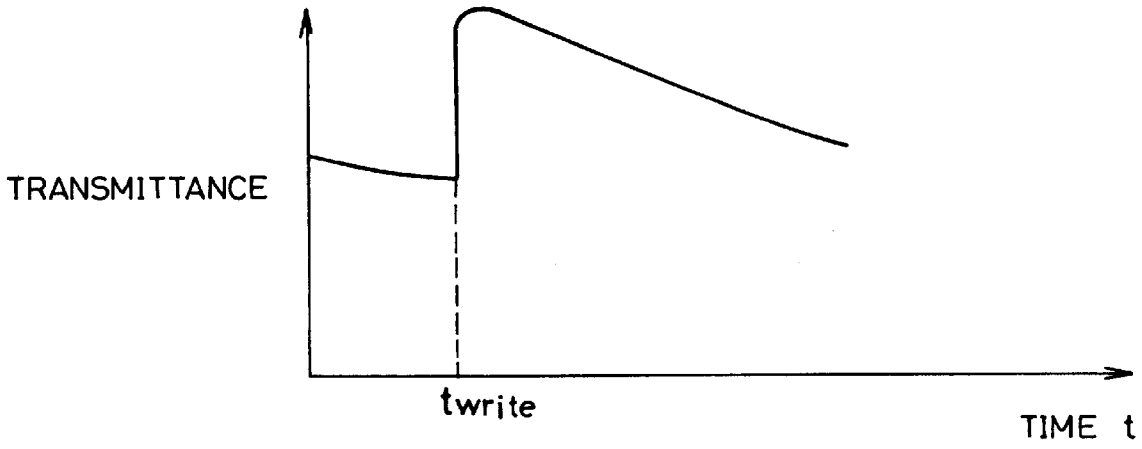
FIG.25 PRIOR ART

This transient change in current causes changes in the potential of the power ground of the back-light power supply section 6 and in the potential of the inverter ground of the inverter section 5. In the conventional PWM dimmer driving circuit (see FIG. 21) of the analog system described under the section of Prior Art, the described changes are superimposed on the input signal of the PWM dimmer driving circuit, thereby presenting the problem of generating variations in dimming. On the other hand, when adopting the PWM dimmer driving circuit section 7 of digital system of the present embodiment, the problem of variations in dimming can be prevented.

On the other hand, the inverter section 5 is switched to the oscillation stop mode when the PWM dimming lighting pulse $V_{PWM}$ is switched to the "H" level. In this state, a resonance frequency of the inverter transformer IT and the resonance condenser C (the transistors $Q_1$ and $Q_2$ are turned OFF, and the resonance frequency is different from that of the oscillating state) is high, and a high selectivity are shown. In this state, a serge voltage of around five times as high as the normal voltage is generated at the time point i which causes an excessive load incurred on the components. This surge voltage is of high frequency and high voltage, and the cause of generating noise.

The period from the time point a to the time point f in FIG. 6 is about 30$\mu$ seconds, and the period from the time point i to the time point k where a surge voltage is being generated is also about 30$\mu$ seconds. Additionally, during the period from the time point d to the time point g, a larger current flows and a higher voltage generates compared with those of the normal condition. Therefore, if the oscillation is stopped in the period, a surge voltage of about ten times as high as that of the normal condition may be generated. As the period from the time point f to the time point g is about 30$\mu$ seconds, namely, from the time point a to the time point g is about 60$\mu$ seconds, the "L" level period of the PWM dimming lighting pulse $V_{PWM}$ is required to be at least 60$\mu$ seconds.

In the NTSC system, one horizontal period is 63.5$\mu$ seconds, while in the PAL system, one horizontal period is 64.0$\mu$ seconds. Therefore, the PWM dimming lighting pulse $V_{PWM}$ outputted from the PWM dimmer driving section 7 may be set to one horizontal period. However, in this case the light-on period of the fluorescent tube 4 of only 30$\mu$ seconds is obtained in practice which is by far smaller than the light-on period obtained in the case of two horizontal periods. Also, in terms of reliability, the minimum pulse width of the PWM dimming lighting pulse VPWM is preferably set to two horizontal periods.

People feel the brightness logarithmically. For example, in the NTSC system, the difference in brightness between the case where the PWM dimming flashing pulse $V_{PWM}$ is set to 105 horizontal periods (full lighting) and the case where the PWM dimming flashing pulse $V_{PWM}$ is set to 100 horizontal periods is not obvious (difference of around Log 1.05). On the other hand, when comparing the period including the complete light-out period with the full lighting period from the points of the luminous efficiency and noise, the full lighting is absolutely more effective.

Therefore, it is preferable that the restriction is set for the maximum light-on period. For example, the maximum light-on period may be set to 100 horizontal periods in the case of the NTSC system, and to 120 horizontal periods in the PAL system without the problem in terms of adjusting brightness in practice.

Moreover, if the upper limit and the lower limit are not set in the light-on period, as the period could be adjusted among 125 levels, the control signal DATA of 7 bits would be required. Here, by setting the lower two digits of 7 bits to correspond to fixed information, the control signal DATA of 5 bits is available. For example, by setting the lower two bits to 2, the light-on period can be adjusted among 2–102 horizontal periods in the NTSC system, and 2–122 horizontal periods in the PAL system (dimming ratio of 50:1). Alternatively, by fixing the lower two bits to "0", the lighting period can be adjusted among 4–100 levels in the NTSC system and 4–120 levels in the PAL system (dimming ratio of 25:1).

The system control circuit 2*b* is arranged so as to output the control signal DATA according to the amount of operation in a brightness adjusting operation section (not shown) provided in the liquid crystal display to the PWM dimmer driving circuit section 7. For example, by operating the brightness up-down button of the brightness adjusting operation section, the control signal DATA corresponding to 2, 4, 8, 16, 32, 64 and 128 horizontal periods (in practice, 105 in the NTSC system, and 125 in the PAL system) is generated. As a result, seven levels obtained by doubling each level can be achieved. The intermediate levels of the brightness may be achieved by setting the control signal DATA corresponding 3, 6, 12, 24, 48 and 96 horizontal periods.

The PWM dimmer driving circuit 7 is of the digital system, and the light-on duration can be adjusted by every one horizontal period based on the digital control signal DATA from the system control circuit 2*b*. For example, the brightness can be easily adjusted according to the state of back-light (power voltage of the back-light power supply section 6, the tube current of the fluorescent tube 4 and the temperature of the fluorescent tube 4, etc.), practical brightness, the brightness of the environment, display mode, etc.

The concrete examples of the described adjustment will be presented below.

As illustrated in FIG. 1, the liquid crystal display of the present invention includes an optical detector 30 for converting the intensity of the externally generated light to an electric signal which enables the system control circuit 2*b* to recognize the brightness in the environment. The system control circuit 2*b* automatically adjusts the light-on period of the fluorescent tube 4 by altering the control signal DATA according to the brightness in the environment. For example, outside in a fine day, the brightness is automatically raised by setting the light-on duration long.

The system control circuit 2*b* includes a function for supervising the power source voltage of the back-light power supply section 6. When the power voltage is lowered by not more than a predetermined value, the control signal DATA is outputted to the PWM dimmer driving circuit section 7 so as to have a longer light-on duration.

As illustrated in FIG. 1, the liquid crystal display in accordance with the present embodiment is provided with a temperature detector 31 for converting the temperature value on the surface of the fluorescent tube 4 into an electric signal so that the system control circuit 2*b* can supervise the temperature on the surface of the fluorescent tube 4. The temperature on the surface of the fluorescent tube 4 and the brightness have a predetermined relationship (temperature-brightness characteristic). Namely, a maximum brightness is shown when the temperature of the fluorescent tube 4 is at a certain temperature (for example, 35° C.), and the brightness suddenly drops when the temperature becomes lower than a certain temperature (for example, 25° C.). The system control circuit 2*b* alters the control signal DATA according to the temperature on the surface of the fluorescent tube 4 so that the light-on period of the fluorescent tube 4 can be automatically adjusted.

Alternatively, the light-on period of the fluorescent tube 4 can be automatically adjusted by providing a brightness detector 32 for directly detecting the brightness of the light source so as to have a constant amount of detection as illustrated in FIG. 1.

Other than the display mode for the video signals of the NTSC system and the PAL system, the liquid crystal display may be provided with, for example, a computer graphic display mode. When adopting the liquid crystal display which permits a switching of the display mode, the control signal DATA is altered based on the display mode (i.e., the content of the video image) so as to automatically adjust the light-on period of the fluorescent tube 4.

As described, the liquid crystal display with a back-light control function in accordance with the present embedment includes: a liquid crystal panel 1*a*; a liquid crystal driver 1*b* for periodically performing a screen display on the liquid crystal panel by periodically supplying a driving signal (gate signal) to the liquid crystal display panel 1*a*; the fluorescent tube 4 provided on the back surface of the liquid crystal display panel 1*a*; the inverter section 5 for driving the fluorescent tube 4; and the PWM dimmer driving circuit section 7 for controlling the inverter 5 so as to periodically turn on the fluorescent tube 4 and for dimming by altering a time ratio between the light-on duration and the light-out duration in one frequency. In the described arrangement, the PWM dimmer driving circuit section 7 controls the inverter section 5 so as to have such a lighting frequency that the fluorescent tube 4 flashes m times (m is an integer of not less than n and not a multiple of n) in n screen display (n vertical) periods (n is an integer of not less than 2) of the liquid display panel. This feature is referred to as the first feature.

The first feature offers the following effect. Namely, a smaller variation in brightness of the display screen and higher frequency of the brightness change can be achieved compared with the case of driving the fluorescent tube 4 at frequency which does not satisfy the above condition. As a result, an occurrence of flicker can be effectively prevented. The greatest effect of preventing an occurrence of flicker can be achieved with a lightning period of odd number of flashes (at least three times) in two vertical period. The PWM dimming lighting frequency may be set to such a low frequency of five flashes in two vertical periods or three flashes in two vertical periods. This enables sound noise generated from the inverter section 5 to be reduced.

The liquid crystal display with a back-light control function in accordance with the first feature further includes a liquid crystal panel synchronization forming section 1*d* for generating a display panel vertical synchronizing signal $V_{sy}$ corresponding to the vertical driving frequency of the liquid crystal panel 1*a* by the liquid crystal driver 1*b*. The PWM dimmer driving circuit section 7 includes one-half dividing circuit 8 and the synchronizing set/reset circuit 9 which serve as synchronization means for synchronizing the lighting timing of the fluorescent tube 4 and the driving timing of the liquid crystal panel 1*a* based on the display panel synchronization generating signal $V_{sy}$. In the described arrangement, the inverter section 5 is controlled so as to synchronize the lighting timing of the fluorescent tube 4 with the driving timing of the liquid crystal panel 1*a* at every two screens. This feature is referred to as the second feature. In the present embodiment, the arrangement for synchronizing at every two screens has been shown. However, the present invention is not limited to this arrangement.

The second feature offers the following effect. Namely, even a small phase difference between the lighting frequency of the fluorescent tube 4 and the driving frequency of the liquid crystal panel 1*a* can be corrected. Therefore, the correlation between the lighting frequency of the fluorescent tube 4 and the driving frequency of the liquid crystal panel 1*a* can be maintained substantially constant, thereby effectively preventing an occurrence of flutter.

The liquid crystal display with a back-light control function in accordance with the present embodiment in accordance with the first or the second feature is provided with the liquid crystal panel synchronization generating section 1*d* for generating the display panel horizontal synchronizing signal $H_{sy}$ corresponding to the horizontal driving frequency of the liquid crystal panel 1*a* by the liquid crystal driver 1*b*. The PWM dimmer lighting circuit section 7 includes two-fifths vertical period dividing circuit 10 as dividing means for dividing the frequency of the display panel horizontal synchronizing signal $H_{sy}$. In the described arrangement, the lighting frequency of the fluorescent tube 4 is obtained by dividing the frequency of the display panel horizontal synchronizing signal $H_{sy}$. This feature is referred to as the third feature.

The third feature offers the following effects. Namely, by obtaining the lighting frequency of the fluorescent tube 4 by dividing the frequency of the display panel horizontal synchronizing signal $H_{sy}$ corresponding to the horizontal driving frequency which has a correlation with the vertical driving frequency, a phase difference between the lighting frequency of the fluorescent tube 4 and the driving frequency of the liquid crystal panel 1*a* can be reduced, thereby preventing an occurrence of flutter. On the other hand, in the conventional method, the lighting frequency is determined by the oscillation means such as a triangular wave oscillating circuit (see FIG. 21). This conventional method has the problem that since oscillation means has an adverse effect from a noise generated in the inverter circuit, a constant lighting frequency cannot be achieved. In order to prevent the problem associated with the conventional method, the liquid crystal display in accordance with the present embodiment is arranged so as to obtain the lighting frequency by dividing the frequency of the display panel horizontal synchronizing signal $H_{sy}$. As a result, a stable lighting frequency can be obtained without being affected by the noise generated in the inverter section 5.

According to the third feature, it is preferable that when displaying the processed video signal of the NTSC system on the liquid crystal panel, the frequency of the display panel horizontal synchronizing signal $H_{sy}$ is divided by 105, while displaying a processed video signal of the PAL system on the liquid crystal panel 1*a*, the display panel horizontal synchronizing signal $H_{sy}$ is divided by 125 so as to obtain a frequency of 5 flashes in 2 vertical periods. In this way, the relationship for the synchronization between the lighting timing of the fluorescent tube 4 and the driving timing of the liquid crystal panel 1*a* can be maintained with respect to the video signal in conformity with the regulation of the NTSC system or the PAL system.

The liquid crystal display with a back-light control function in accordance with the third feature can display both the video signal of the NTSC system and the video signal of the PAL system on the liquid crystal panel 1*a*. The liquid crystal display further includes the video signal processing circuit 2*a* as discrimination means for determining whether the video signal is of the NTSC system or of the PAL system and generating a discrimination signal N/P based on the result of the determination. In this arrangement, the PWM dimmer driving circuit 7 switches the dividing of the frequency of the display panel horizontal signal $H_{sy}$ based on the discrimination signal N/P so as to divide the frequency of the display panel horizontal synchronizing signal $H_{sy}$ by 105 in the case of the video signal of the NTSC system. On the other hand, the PWM dimmer driving circuit section 7 divides the frequency of the display panel horizontal synchronizing signal $H_{sy}$ 125 in the case of the video signal of the PAL system. This feature is referred to as the fourth feature.

The fourth feature offers the following effects.

Namely, the liquid crystal display can be applied to the video signal of both television systems (NTSC system and PAL system).

The liquid crystal display with a back-light control function of the present embodiment having the third or fourth feature includes a system control circuit 2*b* which serves as light-on period set means for setting a light-on duration of the fluorescent tube 4 in one lighting frequency. The PWM dimmer driving circuit section 7 includes count means for counting a number of pulses of the display panel horizontal synchronizing signal $H_{sy}$ and determines the light-on duration set by the system control circuit 2*b* based on a count of the number of pulses of the display panel horizontal synchronizing signal $H_{sy}$. This feature is referred to as a fifth feature.

As a result, unstable brightness (variation in dimming) associated with the conventional PWM dimming of the analog system (see FIG. 21) can be eliminated. Namely, in the conventional PWM dimming of the analog system, the noise generated in the inverter circuit is superimposed on the control input signal $V_{cl}$ (see FIG. 21), and a constant time ratio between the light-on duration and the light-out duration cannot be achieved, thereby presenting the problem of unstable brightness. In order to counteract the above-mentioned problem, the light-on period is determined by counting the number of pulses of the display panel horizontal synchronizing signal $H_{sy}$ in the present embodiment. Therefore, the above-mentioned problem can be solved without being affected by a noise generated in the inverter section 5.

The liquid crystal display device having a back-light control function in accordance with the fifth feature may be arranged such that the system control circuit 2*b* sets the light-on duration which prevents a complete light-on and a complete light-out, in order to limit a minimum light-on duration and a minimum light-out duration in one lighting frequency of the fluorescent tube 4, the light-on duration is not set longer than a lower limit of the light-on duration nor shorter than an upper limit of the light-on period. This feature is referred to as the sixth feature.

The sixth feature offers the following effect. According to this arrangement, the complete light on and complete light out can be avoided, and the limit of the minimum light-on period and the minimum light-out period in one lighting period can be set. Therefore, the problem that the difference in brightness between the light-on state and the light-out state becomes insignificant due to a low luminous efficiency caused by setting the light-on period to short can be prevented. Also, the following effects can be achieved. When a light-out duration is set to be very short, an excessive load would not be incurred to all of the components in the inverter section 5; and even if the light-out duration is set to be too short to have a clear difference between the light-out state and the complete light-on state, the luminous efficiency would not be lowered by the complete light-on state by setting the light-out period, and thus noise would not be generated.

The liquid crystal display with a back-light control function in accordance with the sixth feature may be arranged such that the system control circuit 2*b* sets the light-on period by outputting the control signal DATA corresponding to the number of pulses of the display panel horizontal synchronizing signal $H_{sy}$ to the PWM dimmer driving circuit 7 so as to alter the control signal DATA based on the brightness in environment, the power source voltage, the temperature-brightness characteristic of the fluorescent tube 4, or the display mode so as to automatically correct the light-on period. This feature is referred to as the seventh feature.

As a result, the display can be made at suitable brightness for the present condition of the liquid crystal display device.

In the described preferred embodiment, explanations have been given through the case of displaying the video image of the television signal of the NTSC system and the PAL system. However, the present invention is also applicable to the liquid crystal display designed for the computer graphic display. The PWM dimmer driving circuit section 7 of a hard structure using the synchronizing monostable multivibrator or a down counter with a reset function, etc., is adopted as the dimmer means. However, the dimmer means may be arranged so as to have a soft structure composed of the functional module of the CPU (Central Processing Unit) for executing the program in the memory. In the second embodiment, the liquid crystal display provided with a switchable display function between the television image and the computer graphic (hereinafter referred to as CG) wherein the dimming means is composed of the functional module of the CPU for executing the program in the memory will be explained.

[Embodiment 2]

Figure 19:
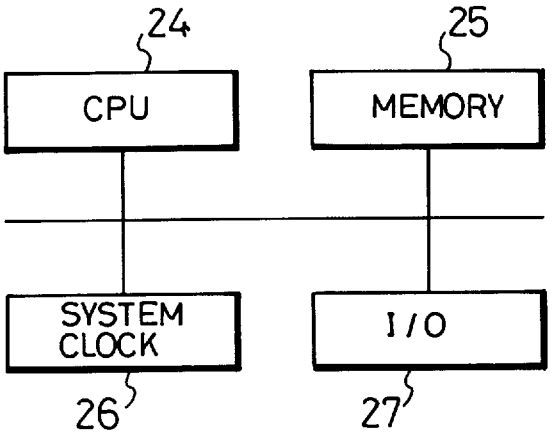
FIG. 19 is a block diagram showing a schematic configuration of a system control circuit of the liquid crystal display device.
Figure 20:
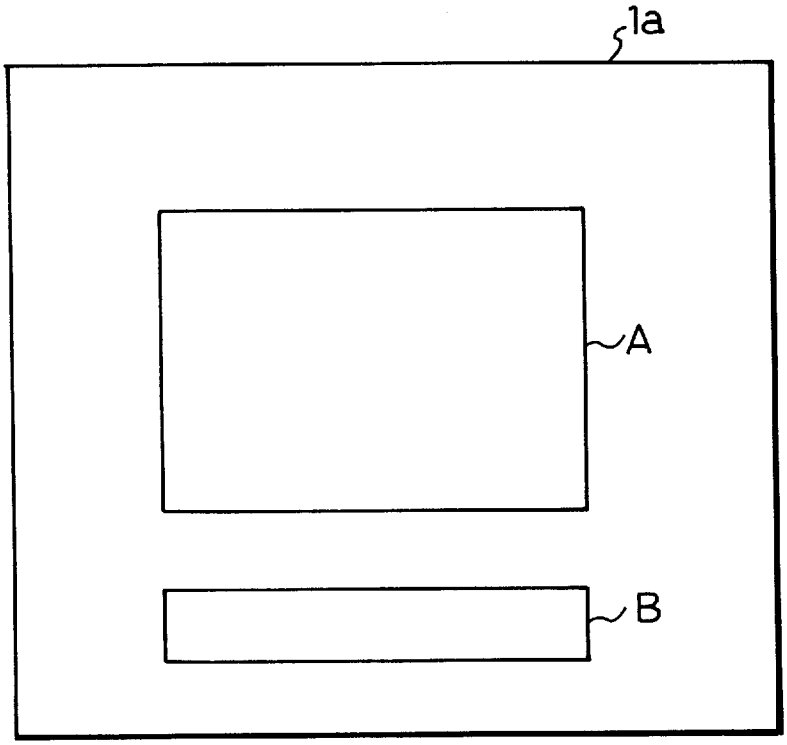
FIG. 20 which explains a still another embodiment of the present invention, is a schematic plan view showing a liquid crystal panel having two display areas.

The following descriptions will discuss another embodiment of the present invention in reference to FIG. 18 through FIG. 20. For convenience, members having the same functions as the aforementioned embodiments will be designated by the same reference numerals, and thus the descriptions thereof shall be omitted here.

A liquid crystal display with a back-light control function in accordance with the present invention is, for example, applicable to a car navigation system with a liquid crystal display panel, etc. The liquid crystal display panel includes a liquid crystal module 1' and an image processing/CG processing/system control section 20 as illustrated in FIG. 18.

The liquid crystal module 1' has the same configuration as that of the liquid crystal module 1 of the previous embodiment except that the liquid crystal panel control section 1*c* is omitted. The liquid crystal module 1' is regulated by a display panel vertical synchronizing signal $V_{sy}$, a display panel horizontal synchronizing signal $H_{sy}$ and a source clock pulse CK supplied from the external section.

The image processing/CG processing/system processing section 20 includes an image processing circuit 2*a*, a CG section 21, a video signal switching section 22 and a system control circuit 23.

The CG section 21 generates CG video signals $R_c$, $G_c$ and $B_c$ separated into three primary colors (R, G and B) according to the control data from the system control circuit 23. The CG section 21 includes an external synchronizing clock generating section 21*a*, an internal clock generating section 21*b* and a liquid crystal panel synchronization forming section 21*c* (vertical synchronizing signal generation means).

The external synchronizing clock generating section 21*a* generates an external clock of a predetermined frequency in synchronous with a composite synchronizing signal $C_{sy}$ separated from an input video signal $V_{BS}$ in the image processing circuit 2*a*. The internal clock generating section 21*b* generates an internal clock of a predetermined frequency. The liquid crystal panel synchronizing section 21*c* switches between the external synchronizing clock and the internal clock based on an instruction from the system control section 23, and outputs a clock thus switched to the liquid crystal module 1' as a source clock pulse CK. The liquid crystal panel synchronization forming section 21*c* also generates a display panel vertical synchronizing signal $V_{sy}$ and a display panel horizontal synchronizing signal $H_{sy}$ by dividing the switched clock, to be outputted to the liquid crystal module 1'.

The video signal switching section 22 switches a signal to be outputted to the liquid crystal module 1' as the video signal $V_R$, $V_G$ or $V_B$ into either the video signal RT, GT or BT separated from the input video signal VBS in the image processing circuit 2a or into the CG video signal $R_C$, $G_C$ or $B_C$ generated in the CG section 21 based on an instruction from the system control circuit 23.

The system control circuit 23 controls an entire liquid crystal display according to an operation of an operation unit (not shown) in the liquid crystal display. As illustrated in FIG. 19, the system control circuit 23 is composed of a microcomputer including a CPU 24, a memory 25, a system clock generating section 26 for generating a system clock $CK_S$ of a predetermined frequency and an input/output control section 27 (hereinafter referred to as I/O section).

As illustrated in FIG. 18, the system control circuit 23 includes a light-on period setting section 28 (light-on period setting means). The light-on period setting section sets a light-on period in one lighting period of the fluorescent tube 4 according to the amount of operation by a brightness adjustment control section (not shown) provided in the liquid crystal display. The system control section 23 also includes a PWM dimmer section 29 (dimmer means). The PWM dimmer section 29 generates a PWM dimming lighting pulse $V_{PWM}$ based on the display panel vertical synchronizing signal $V_{sy}$ generated in the liquid crystal panel synchronizing section 21*c* of the CG section 21, a system clock $CK_S$ generated in the system clock generating section 26 and a value set by the light-on period setting section 28.

The light-on period setting section 28 and the PWM dimmer section 29 serve as a functional module of the system control circuit 23 composed of a memory 25 for storing therein a predetermined program and a CPU 24 for executing the program stored in the memory 25.

The PWM dimmer section 29 generates a PWM dimming lighting pulse $V_{PWM}$ having a frequency obtained by counting the system clock $CK_S$ by five in two vertical periods while synchronizing the lighting timing with a display driving timing at every two vertical periods based on an input of the display panel vertical synchronizing signal $V_{sy}$.

In the described arrangement, the system control circuit 23 controls the CG section 21 and the video signal switching section 22 according to the operation of the display mode switching operation circuit (not shown) provided in the liquid crystal display so as to switch a display mode between the television display mode for displaying an image of the television system and the CG display mode for displaying a CG video image. When switching the display mode, the PWM dimmer section 29 sets the number of pulses of the system clock $CK_S$ which determines one lighting period (a period obtained by dividing by five in two vertical periods) according to the video signal of the NTSC system and the video signal of the PAL system, etc.

According to the described arrangement, in either mode of the television display mode and CG display mode, the PWM dimming is performed with such a frequency that 5 flashes occur in 2 vertical periods, thereby effectively preventing an occurrence of flicker. Moreover, as the PWM dimming frequency and the driving frequency of the liquid crystal panel 1*a* are synchronized at every two vertical periods, an occurrence of flutter can be also prevented.

For example, as shown in FIG. 20, the present invention is also applicable to the liquid crystal display having a liquid crystal panel 1*a* wherein an area A for displaying a video image of the television system and an area B for displaying a CG image such as a character, etc., are formed so as to display the video images respectively in the display areas A and B simultaneously. In this case, by setting the relationship between a display frequency in the display area A and a display frequency in the display area B to be an integer multiples, the PWM dimming can be applied to both of the display areas A and B with a lighting frequency of the fluorescent tube 4 which is set to m flashes (m is an integer of not less than n, and is not a multiple of n) in n image display periods (n is an integer of not less than 2). Namely, the same effect can be achieved in the case where plural display areas of different display frequencies are formed in the liquid crystal panel 1*a* only by providing a single fluorescent tube 4 on the back surface of the liquid crystal panel 1*a*.

In each of the described preferred embodiments, the liquid crystal module 1 (1') of a linear sequential non-interlacing scanning system for performing a linear sequential scanning is adopted. However, the liquid crystal model of the present invention is not limited to this type, and that of the linear sequential interlacing scanning system or of dot sequential scanning system may be adopted as well. The present invention can be also applied to the liquid crystal device of a segment display system. Additionally, although the liquid crystal panel 1*a* with a display system of a normally black type (negative display type) is adopted, that of the normally white type (positive display type) wherein it is set in the transmissive mode in the normal condition (OFF position of the power source) while set in the non-transmissive mode when a signal is supplied to each picture element may be adopted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display with a back-light control function, comprising:

a liquid crystal panel;

display panel driving means for periodically displaying on said liquid crystal display panel by periodically supplying thereto a driving signal;

a light source formed on a back surface of said liquid crystal display panel;

light source driving means for driving said light source; and dimmer means for dimming with a varying time ratio between a light-on duration and a light-out duration in one lighting period by controlling said light source driving means so as to flash said light source periodically, wherein said dimmer means controls said light source driving means so as to set the lighting frequency for flashing said light source such that m flashes occur, where m is an integer larger than n, and not a multiple of n, in n screen display periods of said liquid crystal panel, where n is an integer larger than 2 and where a screen display period is a period for the liquid crystal display to refresh its content once.

2. The liquid crystal display with the back-light control function as set forth in claim 1, wherein:

said dimmer means controls said light source driving means so as to have a lighting frequency such that said light source flashes odd number of at least three times in 2 screen display periods.

3. The liquid crystal display with a back-light control function as set forth in claim 1, wherein:

said light source is a fluorescent tube, and said light source driving means includes a direct current power supply and an inverter circuit for converting a direct current from said direct current power supply into a high frequency alternate current to be applied to said fluorescent tube.

4. The liquid crystal display with a back-light control function as set forth in claim 1, further comprising:

vertical synchronizing signal generation means for generating a display panel vertical synchronizing signal corresponding to a vertical driving frequency of said liquid crystal display panel by said display panel driving means, wherein said dimmer means includes synchronization means for synchronizing the lighting timing of said light source with a driving timing of said liquid display panel, and controls said light source driving means while synchronizing the lighting timing of said light source with the driving timing of said liquid crystal display panel at every predetermined screens.

5. The liquid crystal display with a back-light control function as set forth in claim 4, wherein:

said synchronization means includes an one-half dividing circuit for dividing a frequency of the display panel vertical synchronizing signal into one-half, and said synchronization mean s synchronizes the lighting timing of said light source with the driving timing of said liquid crystal display panel at every 2-screen period.

6. The liquid crystal display with a back-light control function as set forth in claim 1, further comprising:

horizontal synchronizing signal generating means for generating a display panel horizontal synchronizing signal corresponding to a horizontal driving frequency of said liquid crystal display panel by said display panel driving means, wherein said dimmer means includes dividing means for dividing a frequency of the display panel horizontal synchronizing signal so as to set the lighting frequency of said light source by dividing the frequency of the display panel horizontal synchronizing signal.

7. The liquid crystal display with a back-light control function as set forth in claim 6 further comprising:

image processing means for converting a television image of a NTSC system in which 2 vertical periods correspond to 525 horizontal periods into a suitable format to be processed in said display panel driving means, wherein said dimmer means sets the lighting frequency of the light source such that 5 flashes occur in 2 screen display periods by dividing the frequency of the display panel horizontal synchronizing signal by 105.

8. The liquid crystal display with a back-light control function as set forth in claim 6 further comprising:

image processing means for converting a television image of a PAL system in which 2 vertical periods correspond to 625 horizontal periods into a suitable format to be processed in said display panel driving means, wherein said dimmer means sets the lighting frequency of the light source such that 5 flashes occur in 2 screen display periods by dividing the frequency of the display panel horizontal synchronizing signal by 125.

9. The liquid crystal display with a back-light control function as set forth in claim 6, further comprising:

video processing means for converting the television video signal into a suitable format to be processed in said display panel driving means so as to enable both a television image of the NTSC system in which 2 vertical periods correspond to 525 horizontal periods and a television image of the PAL system in which 2 vertical periods correspond to 625 horizontal periods to be displayed on said liquid crystal display panel, wherein said image processing means includes judging means for determining whether the television video signal is of the NTSC system or of the PAL system so as to output a discrimination signal indicating a result of determination, and said dimmer means switches a dividing ratio of said dividing means based on the discrimination signal, and divides the frequency of the display panel horizontal synchronizing signal by 105 when the discrimination signal is of the NTSC system, while divides the frequency of the display panel horizontal synchronizing signal by 125 if the discrimination signal is of the PAL system so as to set the lighting frequency of said light source such that 5 flashes occur in 2 vertical periods irrespectively of a system of the television video signal.

10. The liquid crystal display with a back-light control function as set forth in claim 6, further comprising:

light-on period set means for setting the light-on period in one lighting frequency of said light source, wherein said dimmer means includes count means for counting a number of pulses of the display panel horizontal synchronizing signal and determines the light-on period set by said light-on period set means based on a count of the number of pulses of the display panel horizontal synchronizing signal.

11. The liquid crystal display with a back-light control function as set forth in claim 10, wherein when said light-on period set means sets the light-on duration so as to prevent a complete light-on and a complete light-out, said light-on period set means does not set the light-on duration shorter than a lower limit of a light-on duration set beforehand nor longer than a upper limit of the light-on duration set beforehand to limit a minimum light-on duration and a minimum light-out duration in one lightning frequency of said light source.

12. The liquid crystal display with a back-light control function as set forth in claim 10, wherein:

said light-on period set means sets a light-on duration by outputting digital control data corresponding to a number of pulses of the display panel horizontal synchronizing signal to said dimmer means, and said dimmer means alters a count value of said count means for counting a number of flashes of said light source in one lighting period of said light source based on the digital control data.

13. The liquid crystal display with a back-light control function as set forth in claim 12, wherein said light-on period set means includes detection means for detecting an intensity of incident light from an outside, and said light-on period set means is provided with an automatic correcting function for alternating the control data so as to set the light-on duration longer as the intensity of the incident light from the outside increases.

14. The liquid crystal display with a back-light control function as set forth in claim 12, wherein said light-on period set means monitors a power source voltage of said light source driving means for driving said light source and is provided with an automatic correcting function for alternating the control data so as to set the light-on duration longer when the power source voltage becomes lower than a predetermined level.

15. The liquid crystal display with a back-light control function as set forth in claim 12, wherein: said light source is a fluorescent tube, and said light-on period set means includes detection means for detecting a temperature on a surface of the fluorescent tube, and is provided with an automatic adjusting function for alternating the control data according to a detection output from said detection means.

16. The liquid crystal display with a back-light control function as set forth in claim 12, wherein:

said light-on period set means includes detection means for detecting a brightness of said light source and is provided with an automatic adjusting function for alternating the control data based on a detection output from said detection means.

17. The liquid crystal display with a back-light control function as set forth in claim 1, further comprising:

television image processing means for converting a television image into a suitable form to be processed by said display panel driving means;

computer graphic image processing means for converting a computer graphic image into a suitable form to be processed in said display panel driving means; and image switching means for switching a video signal to be inputted to said display panel driving means either to a video signal processed in said television video processing means or to a video signal processed by said computer graphic image processing means.

18. The liquid crystal display with a back-light control function as set forth in claim 1, wherein said liquid crystal display panel includes plural display areas respectively having different display periods so as to enable plural images to be displayed simultaneously, and said display panel driving means controls a display in each display area such that a display frequency of one display area is an integer multiple of a display frequency of another display area.

19. The liquid crystal display with a back-light control function as set forth in claim 1, further comprising:

television image processing means for converting a television image into a suitable form to be processed in said display panel driving means;

computer graphic video processing means for converting the computer graphic image into a suitable form to be processed in said display panel driving means, wherein said liquid crystal panel includes a first display area for displaying the television image and a second display area for displaying the computer graphic image, and said display panel driving means controls a display in each display area such that a display frequency of one of the first display area and the second display area is an integer multiple of a display frequency of the second display area and the first display area, respectively.

20. A method for reducing flicker in a liquid crystal display with a back-light control function, comprising the steps of:

periodically displaying on said a crystal display panel by periodically supplying thereto a driving signal;

driving a light source formed on a back surface of said liquid crystal display panel;

dimming with a varying time ratio between a light-on duration and a light-out duration in one lighting period flashing said light source periodically; and setting the lighting frequency for flashing said light source such that m flashes occur, where m is an integer larger than n, and not a multiple of n, in n screen display periods of said liquid crystal panel, where n is an integer larger than 2 and where a screen display period is a period for the liquid crystal display to refresh its content once.

21. The method as recited in claim 20, further comprising:

generating a display panel vertical synchronizing signal corresponding to a vertical driving frequency of said driving step;

dividing a frequency of the display panel vertical synchronizing signal into one-half; and synchronizing the lighting timing of said light source with the driving timing of said liquid crystal display panel at every two screen period.

22. The method as recited claim 20, further comprising:

generating a display panel horizontal synchronizing signal corresponding to a horizontal driving frequency of said liquid crystal panel by said driving step; and dividing a frequency of the display panel horizontal synchronizing signal so as to set the lighting frequency of said light source by dividing the frequency of the display panel horizontal synchronizing signal.

* * * * *